US007979009B2

(12) United States Patent
Horikawa

(10) Patent No.: US 7,979,009 B2
(45) Date of Patent: Jul. 12, 2011

(54) DEVELOPER SUPPLYING CARTRIDGE INCLUDING A DEVELOPER SUPPLYING PORT SHUTTER PORTION AND ELECTROPHOTOGRAPHIC IMAGE FORMING APPARATUS USING THE CARTRIDGE

(75) Inventor: Tadashi Horikawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 755 days.

(21) Appl. No.: 12/014,407

(22) Filed: Jan. 15, 2008

(65) Prior Publication Data

US 2009/0035012 A1 Feb. 5, 2009

(30) Foreign Application Priority Data

Aug. 3, 2007 (JP) ..... 2007-202449

(51) Int. Cl.
*G03G 15/08* (2006.01)

(52) U.S. Cl. ..... 399/258

(58) Field of Classification Search ..... 399/258, 399/260, 262

See application file for complete search history.

(56) References Cited

U.S. PATENT DOCUMENTS

| | | | | |
|---|---|---|---|---|
| 7,555,249 | B2 * | 6/2009 | Kawai | 399/258 |
| 7,805,098 | B2 * | 9/2010 | Kimura et al. | 399/258 |
| 2007/0212118 | A1 | 9/2007 | Nagae et al. | |

FOREIGN PATENT DOCUMENTS

| | | | |
|---|---|---|---|
| JP | 7-36269 | A | 2/1995 |
| JP | 8-76578 | A | 3/1996 |
| JP | 2006-309147 | A | 11/2006 |

OTHER PUBLICATIONS

Japanese Office Action dated Jul. 7, 2009 in Japanese Application No. 2007-202449, and an English-language translation therefor.

* cited by examiner

*Primary Examiner* — William J Royer
(74) *Attorney, Agent, or Firm* — Fitzpatrick, Cella, Harper & Scinto

(57) ABSTRACT

A developer supplying cartridge including a supply developer containing portion, a developer supplying port for supplying a developer in the supply developer containing portion to a developing device via a supplied port of the developing device, and a supplying port shutter unit that opens and closes the developer supplying port and that includes a housing member covering the developer supplying port, a cylindrical member which is rotatably disposed in the housing member, and provided with a through-hole corresponding to the developer supplying port, and which assumes, by its rotation, a developer supply allowing position where the developer supplying port and the through-hole communicate with each other and a developer supply stopping position where the developer supplying port is closed, and a scraping member which is abutted on an outer circumferential surface of the cylindrical member to scrape off developer adhering to the outer circumferential surface.

9 Claims, 17 Drawing Sheets

DEVELOPER SUPPLYING CARTRIDGE INCLUDING A DEVELOPER SUPPLYING PORT SHUTTER PORTION AND ELECTROPHOTOGRAPHIC IMAGE FORMING APPARATUS USING THE CARTRIDGE

BACKGROUND OF THE INVENTION

1. Field of the Invention

The present invention relates to a developer supplying cartridge that is detachably mountable to a main body of an electrophotographic image forming apparatus, and an electrophotographic image forming apparatus using the same.

Here, an electrophotographic image forming apparatus (hereinafter, referred to as "image forming apparatus") is the one that forms an image on a recording medium employing an electrophotographic image forming process. Examples thereof include an electrophotographic copying machine, an electrophotographic printer (such as an LED printer and a laser beam printer), an electrophotographic facsimile apparatus and an electrophotographic word processor.

Here, a recording medium is an article on which an image is formed, for example, a recording sheet or an OHP sheet.

2. Description of the Related Art

Conventionally, in an image forming apparatus employing an electrophotographic image forming process, employed is a process cartridge system in which an electrophotographic photosensitive member and process means acting on the electrophotographic photosensitive member are integrated into a cartridge, which is detachably mountable to a main body of the image forming apparatus. By this process cartridge system, since a user himself/herself can conduct the maintenance of an apparatus without labors of a service person, operability can be improved.

Furthermore, an electrophotographic photosensitive member and process means acting on the electrophotographic photosensitive member have respective different product lives. Therefore, there is the one in which a process cartridge integrally incorporating the electrophotographic photosensitive member and a developing device, and a developer supplying cartridge supplying a developer to the process cartridge are formed to be separate parts.

Here, in the case where the process cartridge and the developer supplying cartridge are constructed to be separate parts, in the state in which both the developer supplying cartridge and the process cartridge are mounted in an image forming apparatus, the developer is supplied from the developer supplying cartridge to the process cartridge. Furthermore, employed is the system in which a developer is supplied in small quantities from a supplying opening that is provided in the developer supplying cartridge to a supplied opening that is provided in the process cartridge.

Moreover, on the occasion when a user replaces the process cartridge and the developer supplying cartridge, the leakage of a developer needs to be prevented. Therefore, a supplying opening and a supplied opening, in order to prevent the leakage of the developer therearound, are thought to be provided with a shutter that can be opened and closed.

As a general supplying opening shutter construction, there are a slide system in which a plate shutter member is slid to open and close a supplying opening, and a disk rotary system in which a disk-like shutter member provided with a hole is rotated to open and close a supplying opening. Furthermore, there is a rotary valve system in which a cylindrical member formed with a through-hole in an outer circumferential surface thereof is rotated, whereby a supplying opening is opened and closed (Japanese Patent Application Laid-Open No. H07-036269).

Incidentally, in the slide system or the disk rotary system, a layout space of a shutter is required other than the extent of the supplying opening for opening and closing the supplying opening. Whereas, the rotary valve system is advantageous for downsizing of an apparatus, since the supplying opening can be opened and closed within the extent of the cylindrical member.

In the above-mentioned rotary valve system, for example, a housing member is provided in the position of a supplying opening for discharging the developer. Thus, it is conceivable that a cylindrical member having a through-hole is rotatably mounted in this housing member, and this cylindrical member is rotated to open or close the supplying opening. In this example, the cylindrical member is rotated to cause the through-hole to communicate with the supplying opening, thereby enabling to supply the developer. In addition, the supplying opening is closed with the cylindrical member by shifting the positions of the through-hole and the supplying opening, thereby enabling to stop to supply the developer.

In such construction, a particular space for the rotation of the cylindrical member is unnecessary, and downsizing of a cartridge can be achieved.

SUMMARY OF THE INVENTION

The present invention is a further improved one of a cartridge having the above-mentioned shutter construction.

The present invention provides a developer supplying cartridge and an electrophotographic image forming apparatus in which the entry of a developer into between a housing member and a cylindrical member can be prevented, and the developer can be scraped off and removed.

Furthermore, the present invention provides a developer supplying cartridge and an electrophotographic image forming apparatus in which the cylindrical member is smoothly rotated in the housing member, and thus the supplying opening can be opened or closed.

In addition, the present invention provides a developer supplying cartridge and an electrophotographic image forming apparatus in which even if there is a fit tolerance between the housing member and the cylindrical member, the leakage of the developer from therebetween can be prevented.

A developer supplying cartridge according to the present invention in order to solve the above-mentioned problems is a developer supplying cartridge detachably mountable to a main body of an electrophotographic image forming apparatus, the developer supplying cartridge supplying a developer to a developing device for developing an electrostatic latent image formed on an electrophotographic photosensitive drum, the cartridge including: a supply developer containing portion containing the developer; a developer supplying port for supplying the developer in the supply developer containing portion to the developing device via a supplied port of the developing device; and a supplying port shutter portion that opens and closes the developer supplying port, wherein the supplying port shutter portion includes: a housing member covering the developer supplying port; a cylindrical member which is rotatably mounted in the housing member, the cylindrical member in which a through-hole corresponding to the developer supplying port is formed and which can assume a developer supply allowing position where the developer supplying port and the through-hole communicate with each other by rotation and a developer supply stopping position where the developer supplying port is closed; and a scraping member which is abutted on an outer circumferential surface of the cylindrical member and which scrapes off the developer adhering to the outer circumference of the rotating cylindrical member.

Further features of the present invention will become apparent from the following description of exemplary embodiments with reference to the attached drawings.

BRIEF DESCRIPTION OF THE DRAWINGS

FIG. 11B is an enlarged view of a circled portion XIB of FIG. 11A.

DESCRIPTION OF THE EMBODIMENTS

Figure 1:
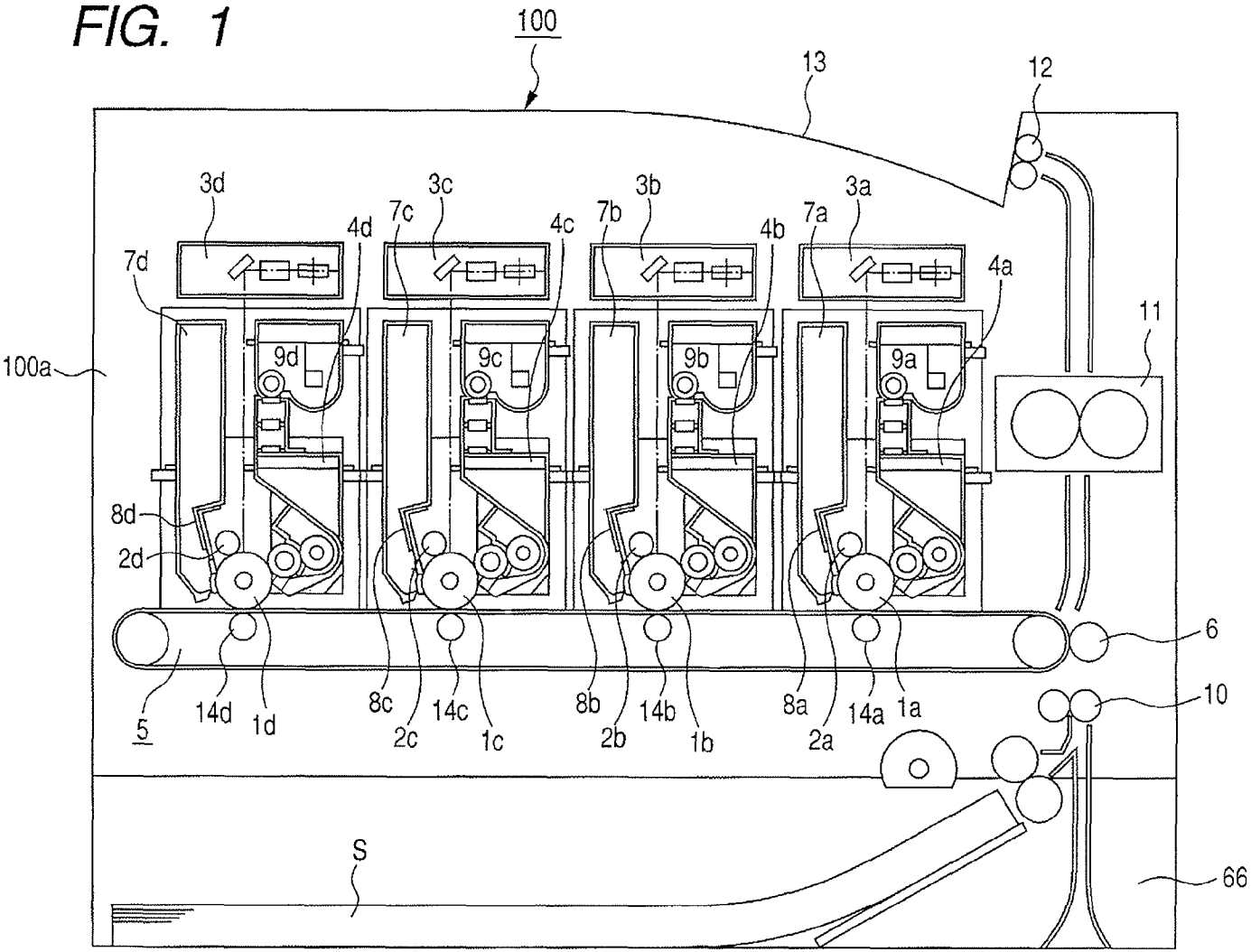
FIG. 1 is a sectional view of a main body of an image forming apparatus.

Now, a color image forming apparatus using a developer supplying cartridge and a process cartridge according to an exemplary embodiment of the present invention will be described referring to the drawings.

Embodiment 1

(Overall Construction of an Image Forming Apparatus)

First, the overall construction of an image forming apparatus will be described with reference to FIG. 1. Incidentally, FIG. 1 is a longitudinal sectional view illustrating the overall construction of a full-color laser beam printer 100, being a mode of an image forming apparatus.

The image forming apparatus 100 includes four process cartridges 7 (7*a*, 7*b*, 7*c*, and 7*d*) and four developer supplying cartridges 9 (9*a*, 9*b*, 9*c*, and 9*d*) which are provided in juxtaposition in a horizontal direction. Each of the process cartridge 7 and the developer supplying cartridge 9 is detachably mountable to an apparatus main body 100*a* of the image forming apparatus 100 independently. Here, the apparatus main body 100*a* is the construction of excluding the process cartridge 7 and the developer supplying cartridge 9 from the construction of the image forming apparatus 100. The process cartridge 7 includes an electrophotographic photosensitive drum 1 (1*a*, 1*b*, 1*c*, 1*d*). This electrophotographic photosensitive drum (hereinafter, referred to as "photosensitive drum") 1 is rotated by driving means (not illustrated) that is provided at the apparatus main body 100*a*.

The process cartridge 7 includes a charging roller (charging means) 2 (2*a*, 2*b*, 2*c*, 2*d*), a developing device 4 (4*a*, 4*b*, 4*c*, 4*d*) and cleaning means 8 (8*a*, 8*b*, 8*c*, 8*d*) as process means, which are arranged around the photosensitive drum 1.

In addition, in the apparatus main body 100*a*, there are around each photosensitive drum 1, one of scanner units 3*a*, 3*b*, 3*c*, 3*d* and an intermediate transfer member 5. Onto the intermediate transfer member 5, a developer image formed on a circumferential surface of the photosensitive drum 1 is transferred by one of primary transfer means 14*a*, 14*b*, 14*c*, 14*d*. Incidentally, the primary transfer means 14 is provided in the apparatus main body 100*a*.

The charging roller 2 is pressed to the photosensitive drum 1, and uniformly charges the surface of the photosensitive drum 1. Each scanner unit 3*a*, 3*b*, 3*c*, 3*d* irradiates the photosensitive drum 1 with a laser beam based on image information to form an electrostatic latent image on the photosensitive drum 1. The developing device 4 (4*a* to 4*d*) causes a developer to adhere to the electrostatic latent image to form a developer image. That is, the developing device 4 develops the electrostatic latent image. The cleaning means 8 removes the developer remaining on the surface of the photosensitive drum 1 after the toner image is transferred.

Here, the photosensitive drum 1, and the charging roller 2, the developing device 4 and the cleaning means 8 serving as the process means are made integrally into a cartridge to form a process cartridge 7.

The operation of image formation is as follows. First, the photosensitive drum 1 is rotated in synchronization with timing of image formation. Then, each scanner unit 3*a*, 3*b*, 3*c*, 3*d* corresponding to each process cartridge 7 is sequentially driven. Furthermore, the charging roller 2 that is driven to rotate in contact with the photosensitive drum 1 is applied with a voltage to provide a uniform electric charge on the circumferential surface of the photosensitive drum 1. The scanner unit 3 selectively makes an exposure based on an image signal on the circumferential surface of the photosensitive drum 1. Whereby, an electrostatic latent image is formed on the circumferential surface of the photosensitive drum 1. A developing roller 17 (17*a* to 17*d*) that is provided in the developing device 4 transports the developer onto the electrostatic latent image. With the arrangement, the developing roller 17 forms the developer image on the circumferential surface of the photosensitive drum 1. That is, the developing roller 17 develops the electrostatic latent image using the developer.

Thereafter, the each primary transfer means 14*a*, 14*b*, 14*c*, 14*d* is applied with a bias voltage of an opposite polarity to that of the developer image. Whereby, the developer image having been formed on the photosensitive drum 1 is primarily transferred onto the intermediate transfer member 5.

Then, the developer images (developer images of four colors) having been formed on respective photosensitive drums 1 are superimposed on the intermediate transfer member 5. Thereafter, secondary transfer means 6 is brought into pressure contact with the intermediate transfer member 5. Then, a recording medium S having been fed by a feed unit 66 and having been waited in a predetermined position by a registration roller 10 is fed out to a nip portion between the intermediate transfer member 5 and the secondary transfer means 6.

Incidentally, there is contained in the process cartridge 7*a* a yellow developer. There is contained in the process cartridge 7*b* a magenta developer. There is contained in the process cartridge 7*c* a cyan developer. There is contained in the process cartridge 7*d* a black developer. Therefore, the photosensitive drum 1*a* is formed with a yellow developer image. Likewise, the photosensitive drum 1*b* is formed with a magenta developer image, the photosensitive drum 1*c* is formed with a cyan developer image, and the photosensitive drum 1*d* is formed with a black developer image.

Incidentally, the process cartridges 7*a*, 7*b*, 7*c* and 7*d* are formed in the same construction, and contain the developers with different colors.

The secondary transfer means 6 is applied with a bias voltage of an opposite polarity to that of the developer. Thus, the developer image on the intermediate transfer member 5 is secondarily transferred all together onto the surface of the recording medium S having been conveyed.

Thereafter, the recording medium S is conveyed to a fixing device 11, and heated and pressed so that the developer image is fixed to the recording medium S. Then, the recording medium S is discharged onto a discharge tray 13 by a discharge roller 12. With the arrangement, image formation has completed.

Incidentally, the developer in the developing device 4 is consumed by the development of the latent image. The developer, accompanied by this consumption, is to be sequentially supplied from the developer supplying cartridge 9 (9*a*, 9*b*, 9*c*, 9*d*) (described later).

Incidentally, the developer supplying cartridges 9*a*, 9*b*, 9*c* and 9*d* are formed in the same construction, and have different colors of contained developers.

Figure 2:
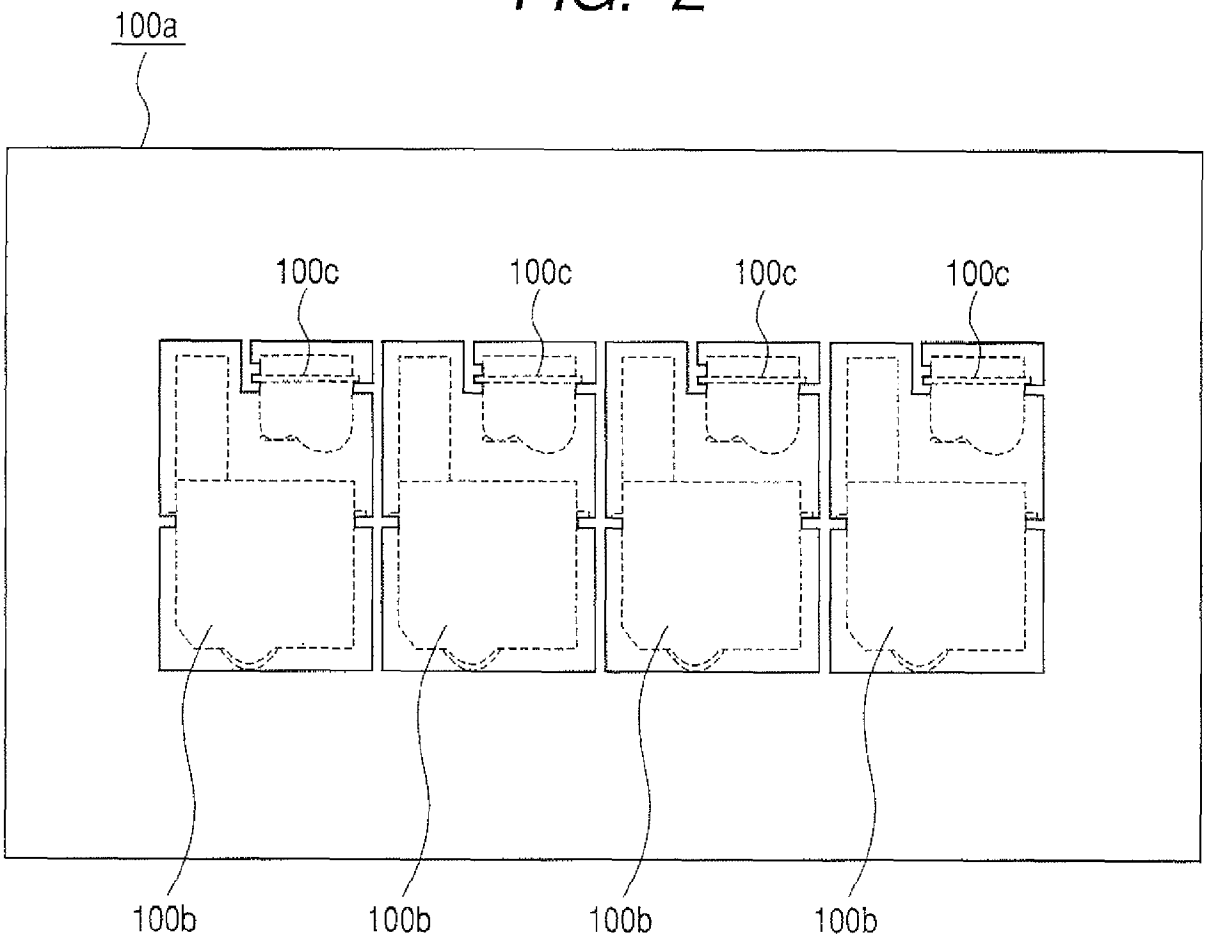
FIG. 2 is a front view of the main body of the image forming apparatus.

In addition, as illustrated in FIG. 2, in the apparatus main body 100*a*, there is provided a process cartridge mounting portion 100*b*, being a space where the process cartridge 7 is detachably mountable. Furthermore, in the apparatus main body 100*a*, there is provided a developer supplying cartridge mounting portion 100*c*, being a space where the developer supplying cartridge 9 is detachably mountable. Both of the mounting portions 100*b* and 100*c* are provided in the apparatus main body 100*a*.

(Entry Mode of a Process Cartridge and a Developer Supplying Cartridge)

Now, with reference to FIGS. 3 and 4, a mode of inserting the process cartridge 7 and the developer supplying cartridge 9 into the apparatus main body 100*a* will be described.

Figure 3:
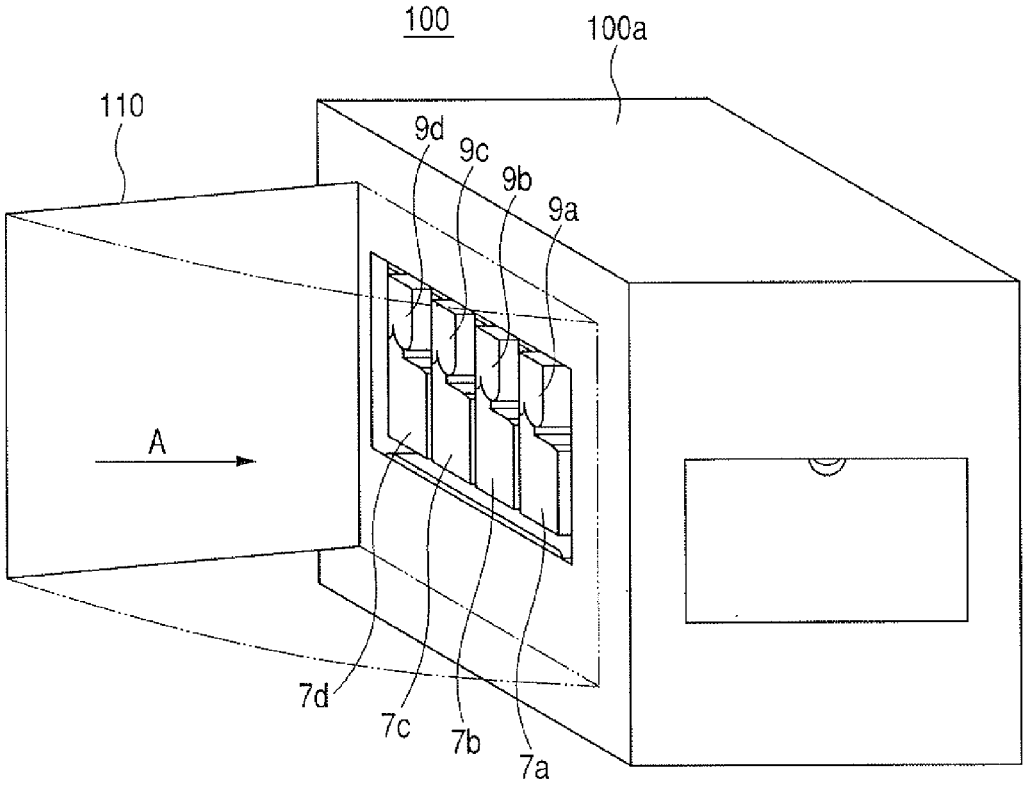
FIG. 3 is a perspective view of an insertion form of a process cartridge and a toner developer supplying cartridge into a color image forming apparatus of an electrophotographic system.

First, an operator, as illustrated in FIG. 3, opens a cartridge cover 110 that is provided at the apparatus main body 100*a*. Then, the operator causes the process cartridge 7 to enter the apparatus main body 100*a* along a longitudinal direction of the photosensitive drum 1 (in a direction indicated by an arrow A in FIG. 3). Furthermore, the operator causes the developer supplying cartridge 9 to enter the apparatus main body 100*a* along the longitudinal direction of a supply developer containing portion 33 (in the direction indicated by the arrow A in FIG. 3). Here, the longitudinal direction of the process cartridge 7 is the direction indicated by the arrow A in FIG. 5, and the longitudinal direction of the developer supplying cartridge 9 is the direction indicated by the arrow A in FIG. 9. That is, both of the cartridges 7 and 9 make an entry in the longitudinal direction thereof. Incidentally, the input of a driving force from the apparatus main body 100*a* to the process cartridge 7 and the developer supplying cartridge 9 is given on the back side in the entry direction (at the back of the apparatus main body 100*a*).

Figure 4:
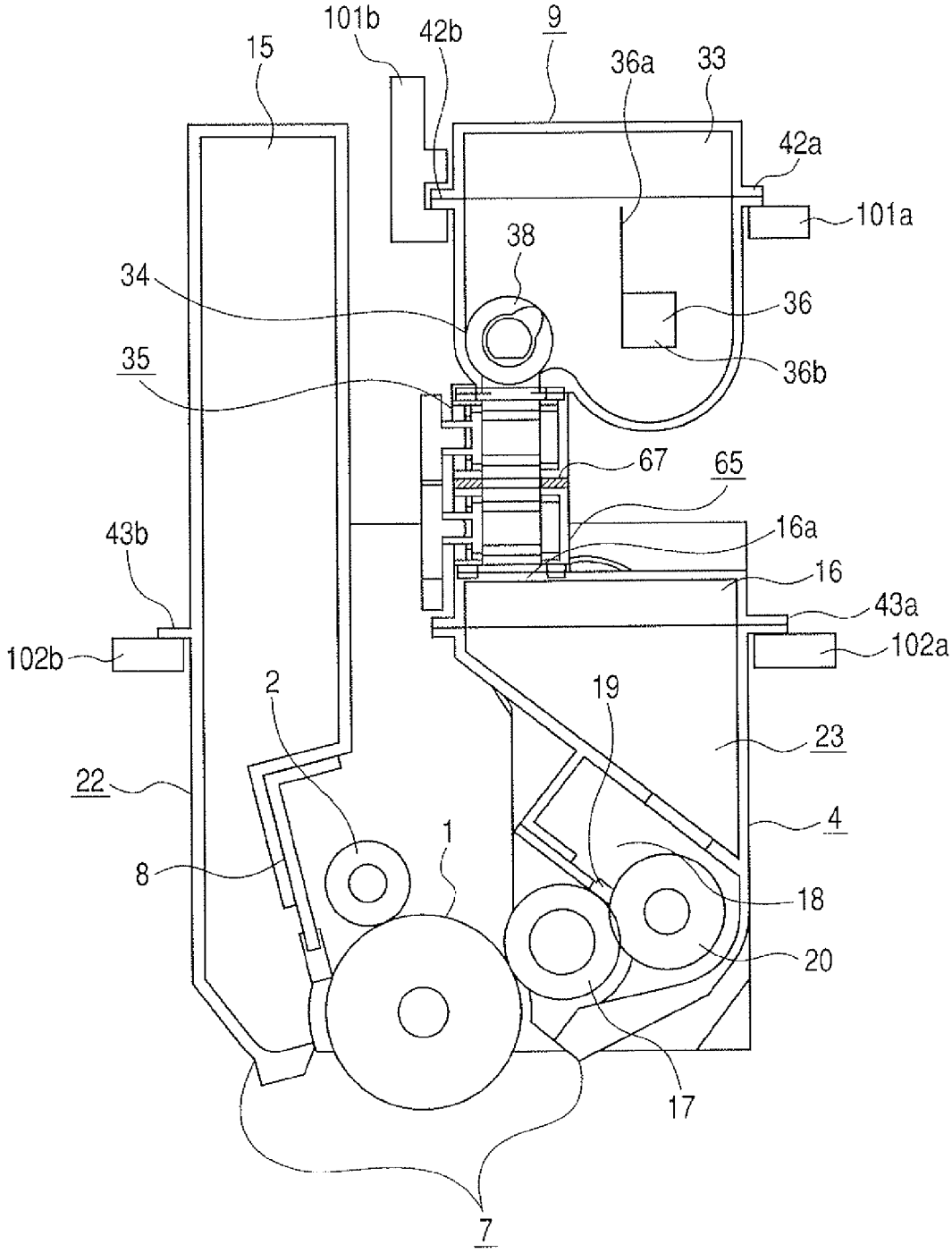
FIG. 4 is a sectional view of the process cartridge and the developer supplying cartridge to be mounted on the image forming apparatus.

The developer supplying cartridge 9, as illustrated in FIG. 4, is inserted with guided portions 42*a* and 42*b* of the developer supplying cartridge 9 put on main body rails 101*a* and 101*b* that are provided in the apparatus main body 100*a*.

In addition, the process cartridge 7 is made to enter with guided portions 43*a* and 43*b* put on main body rails 102*a* and 102*b* that are provided at the apparatus main body 100*a*.

(Frame Construction of a Process Cartridge)

Now, the construction of the process cartridge 7 will be described with reference to FIGS. 4 to 6.

Figure 5:
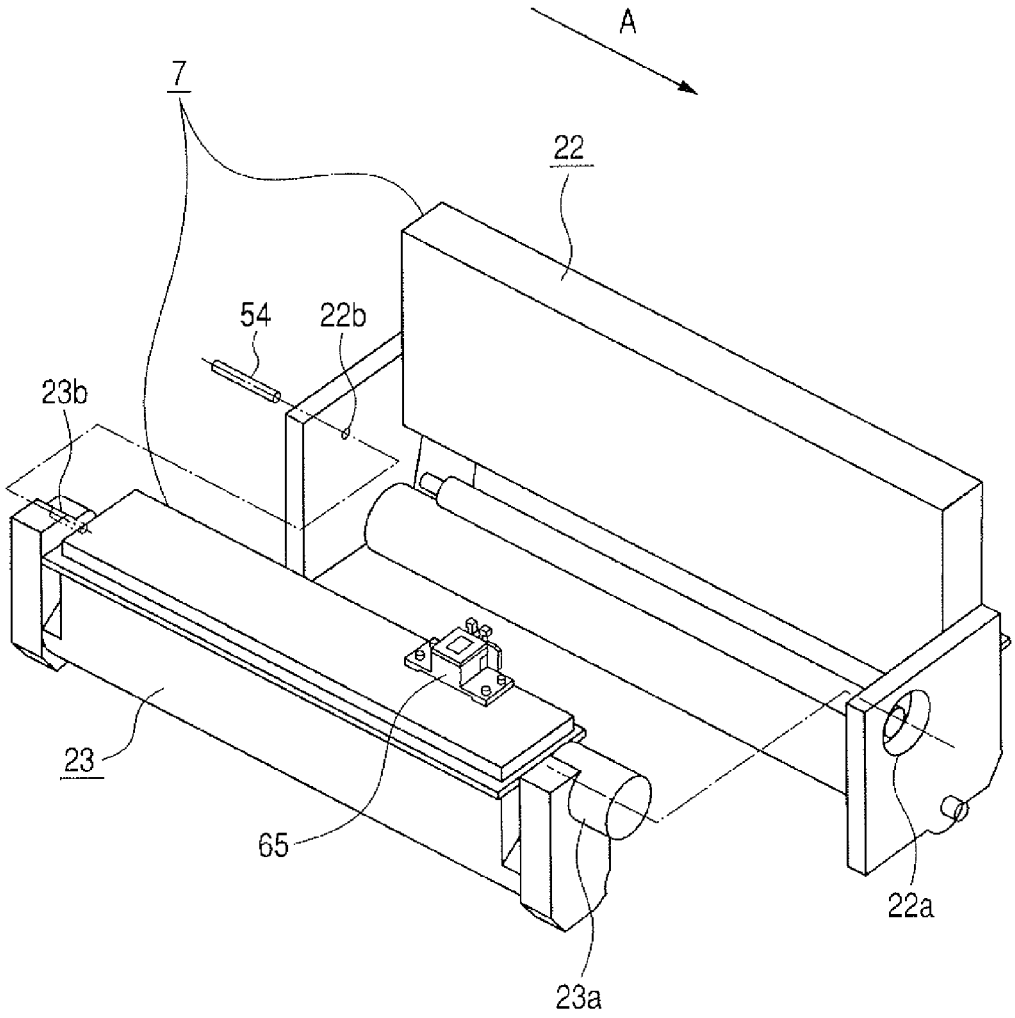
FIG. 5 is a perspective view of the process cartridge.

As illustrated in FIG. 5, the process cartridge 7 is an integral structure of a cleaning unit 22 and a developing unit 23, being separate parts. At this time, on the back side in the inserting direction (in the direction indicated by the arrow A) of the process cartridge 7, a connection shaft 23*a* that is provided on the developing unit 23 and a connection hole 22*a* that is provided in the cleaning unit 22 are fit, thereby making a connection. Whereas, on the front side in the inserting direction, a connection pin 54 is passed through a connection hole 23*b* that is provided in the developing unit 23 and a connection hole 22*b* that is provided in the cleaning unit 22, thereby making a connection. Incidentally, the connection portions in the front and at the back of the process cartridge 7 are provided coaxially. Owing to this construction, the developing unit 23, with respect to the cleaning unit 22, is supported swingably about the connection portions.

Furthermore, as illustrated in FIG. 4, at the cleaning unit 22, there is provided the charging roller 2 in a cleaning container 15, being a frame of rotatably supporting the photosensitive drum 1. In addition, there is provided at the cleaning unit 22 a cleaning blade 8, being the cleaning means. The cleaning blade 8 removes a developer remaining on the photosensitive drum 1.

Whereas, the frame of the developing unit 23 is constructed by a receiving side developer containing portion 16 for containing the developer and a developer container 18 being coupled by e.g., ultrasonic welding. In a new process cartridge 7, a predetermined amount of developer has preliminarily been contained in the receiving side developer containing portion 16. This developer, at the time of using the new process cartridge 7, is provided for image formation until the developer from the developer supplying cartridge 9 has sufficiently been supplied.

In the developer container 18, the developing roller 17 is rotatably supported. Furthermore, there are provided a developing blade 19 for regulating a layer thickness of the developer adhering to the circumferential surface of the developing roller 17, and a developer feed roller 20, being a sponge roller for supplying the developer to the developing roller 17.

In the state in which the process cartridge 7 (7*a* to 7*d*) is mounted in the apparatus main body 100*a*, the developer supplying cartridge 9 (9*a* to 9*d*) is mounted above the developing unit 23 (receiving side developer containing portion 16). Further, above the receiving side developer containing portion 16, there is located a developer supplied port 16*a* to receive the developer from the developer supplying cartridge 9. In addition, above the developer supplied port 16*a*, there is disposed a developer supplied port unit 65 to open and close the developer supplied port 16*a*. The supplied port unit 65 opens and closes the developer supplied port 16*a* by the rotation thereof. Whereby, the supplied port unit 65 can assume a developer receiving allowing position in which the developer supplied port 16*a* for receiving the developer is opened, and a developer receiving stopping position in which the developer supplied port 16*a* is closed. In addition, above the supplied port unit 65, there is disposed a seal member 67 (it is constructed of a urethane foam, a felt and the like) for connecting the process cartridge 7 and the developer supplying cartridge 9 together. Here, the developer supplied port 16*a* serves to receive the developer from the developer supplying cartridge 9 into the receiving side developer containing portion 16.

The process cartridge 7 is detachably mounted in the process cartridge mounting portion 100*b*, and above the process cartridge mounting portion 100*b*, the developer supplying cartridge 9 is detachably mounted in the developer supplying cartridge mounting portion 100*c* (FIG. 1). Incidentally, the process cartridge 7 and the developer supplying cartridge 9 can be mounted and dismounted from the apparatus main body 100*a* independently of each other.

Figure 6:
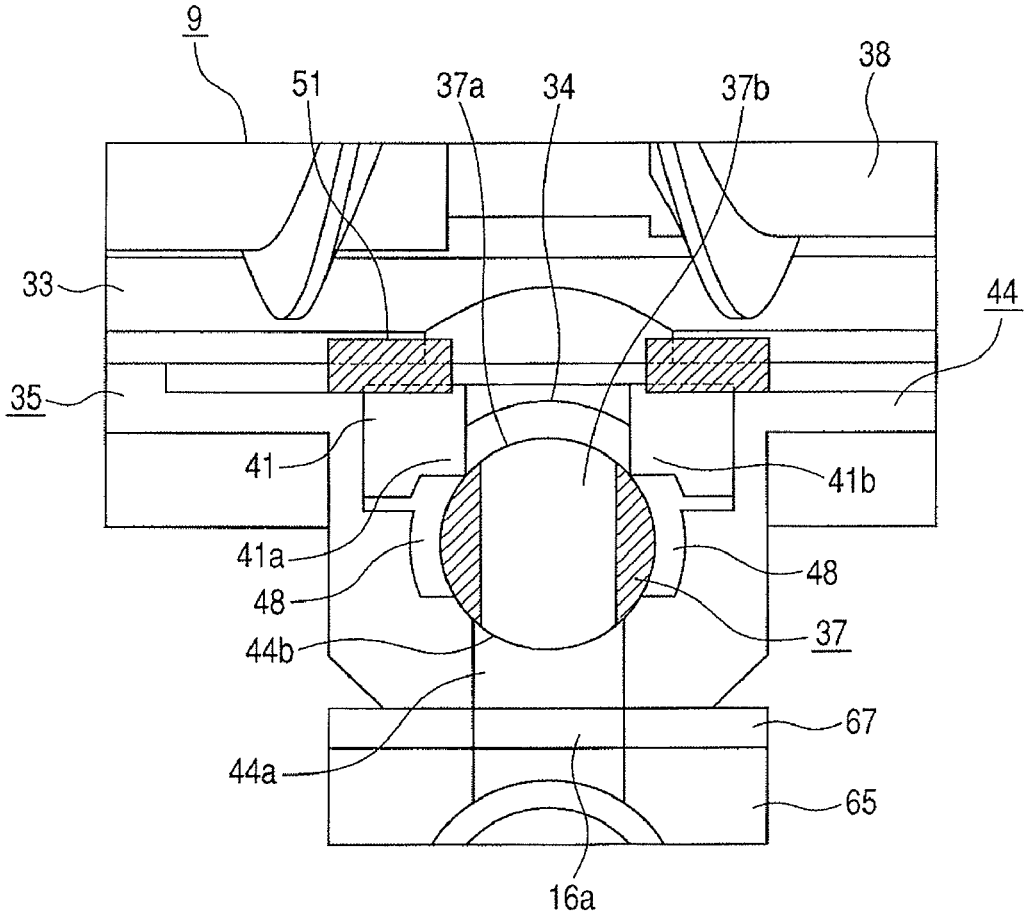
FIG. 6 is a sectional view in a state in which a supplying port shutter unit is opened.

As illustrated in FIG. 6, on the occasion when the developer is supplied from the developer supplying cartridge 9 to the process cartridge 7, the seal member 67 prevents the developer from being leaked from the connection portion between a supplying port shutter unit 35 and the supplied port unit 65. The seal member 67, however, serves to prevent the developer from being leaked still more reliably, and may not be required depending on the construction.

(Construction of a Developer Supplying Cartridge)

Now, with reference to FIG. 4, the construction of the developer supplying cartridge 9 will be described.

The developer supplying cartridge 9 includes the supply developer containing portion 33 for containing the developer. In the state in which the process cartridge 7 and the developer supplying cartridge 9 are mounted in the apparatus main body 100*a*, below the supply developer containing portion 33, there is provided a developer supplying port 34 corresponding to the position of the above-described developer supplied port 16*a*. From this developer supplying port 34 via the developer supplied port 16*a*, the developer in the supply developer containing portion 33 is supplied to the process cartridge 7. Furthermore, above the developer supplying port 34, a screw 38 for supplying the developer is disposed. The screw 38 receives the driving force from the apparatus main body 100*a* to rotate. With the arrangement, the developer is conveyed to the developer supplying port 34.

Furthermore, in the supply developer containing portion 33, there is provided a developer feed member 36 for feeding the developer to the screw 38. In addition, due to that a shaft portion 36*b* of the developer feed member 36 is provided with the force of being driven to turn, a conveying sheet 36*a* that is connected to the shaft portion 36*b* is turned to feed the developer to the screw 38.

Further, below the developer supplying port 34, there is disposed the supplying port shutter unit 35, being a supplying port shutter portion for opening and closing the developer supplying port 34.

(Construction of a Supplying Port Shutter Unit)

Now, with reference to FIGS. 6 to 11B, the construction of the supplying port shutter unit 35 will be described.

As illustrated in FIG. 6, in a housing member 44 forming a frame of the supplying port shutter unit 35, there are provided an opening portion 44*a* corresponding to the position of the developer supplying port 34, and a bearing portion 44*b*, being a circular arc surface. Furthermore, at the housing member 44, there is provided a receiving opening 44*e* on the opposite side to the opening portion 44*a*. In the housing member 44, a cylindrical member 37 is disposed. Due to that the bearing portion 44*b* receives an outer circumferential surface 37*a* of the cylindrical member 37, the cylindrical member 37 is rotatably supported with respect to the housing member 44. Furthermore, in the receiving opening 44*e*, there is disposed a scraping member 41 for scraping the outer circumferential surface 37*a* of the cylindrical member 37.

In addition, at the outer circumferential surface 37*a* of the cylindrical member 37, there is provided a through-hole 37*b*. This through-hole 37*b* communicates with the developer supplying portion 34 when the cylindrical member 37 is in the position illustrated in FIG. 6 (developer supply allowing position). The rotation axis of the cylindrical member 37 is set to be the direction orthogonal to the longitudinal direction of the developer supplying cartridge 9 (inserting direction of the developer supplying cartridge 9 with respect to the apparatus main body 100*a*).

Incidentally, when both the process cartridge 7 and the developer supplying cartridge 9 are mounted on the apparatus main body 100*a*, the supplying port shutter unit 35 is in an open state. On the other hand, in the state other than this state, the supplying port shutter unit 35 is in the closed state.

Figure 7:
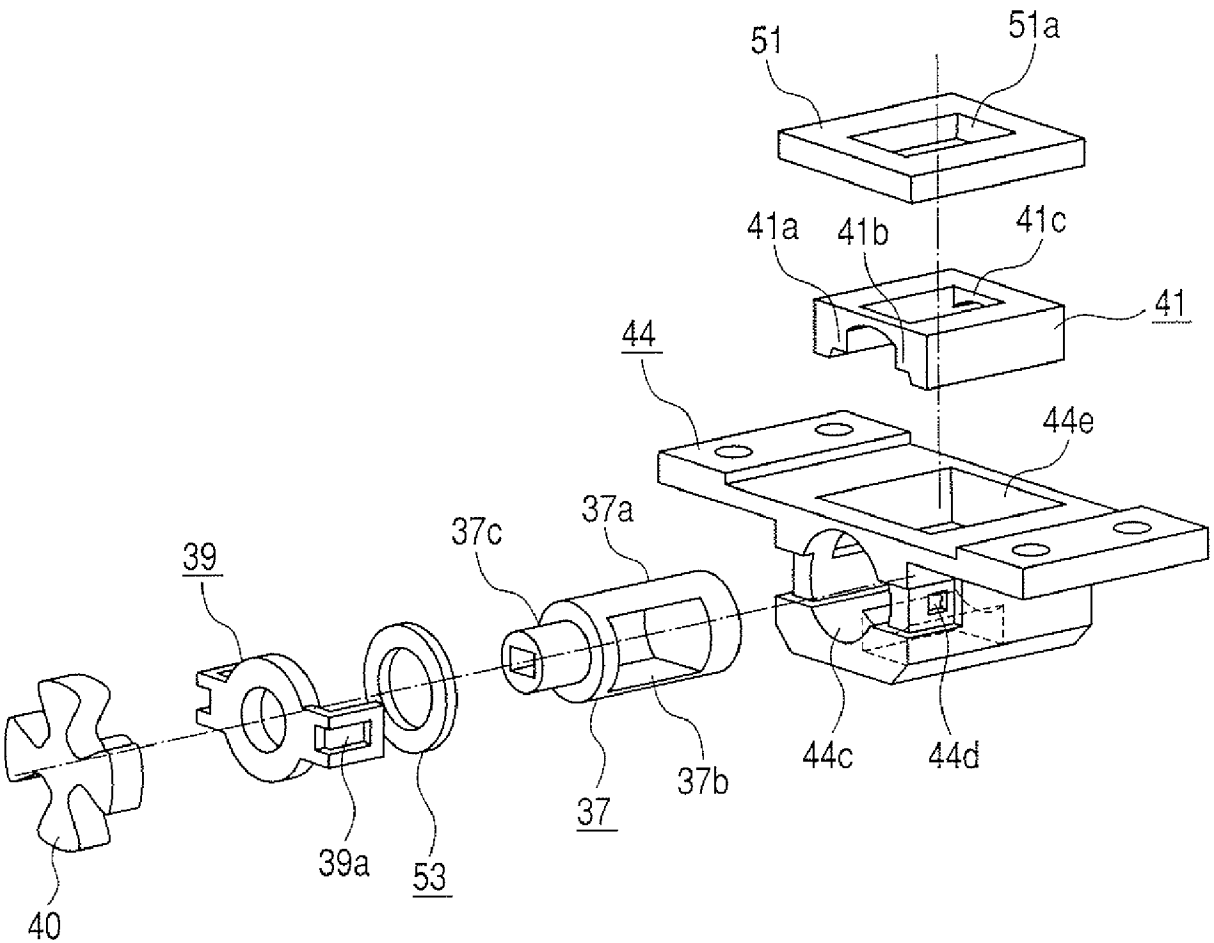
FIG. 7 is a perspective view illustrating mounting of a cylindrical member to a housing member.

Now, an attaching procedure of the cylindrical member 37 with respect to the housing member 44 will be described below. As illustrated in FIG. 7, onto a cylindrical member attaching portion 44*c* provided in the housing member 44, the cylindrical member 37, a cylindrical seal member 53, and a housing cover 39 are attached. The housing member 44 and the housing cover 39 are connected by an attaching hole 39*a* of the housing cover 39 being hooked on a claw portion 44*d* that is provided on the housing member 44. After the housing cover 39 has been attached, an acting portion 40 is attached by press fitting to an end of a shaft portion 37*c* of the cylindrical member 37. The cylindrical member 37 and the acting portion 40 are connected with a rotation-stopper, thus formed into one united body. When the acting portion 40 is rotated, the cylindrical member 37 is rotated as well.

In addition, on the upper side of the cylindrical member 37, disposed is the scraping member 41 for scraping off the developer adhering to the outer circumferential surface 37*a* of the cylindrical member 37. After the cylindrical member 37 has been attached to the housing member 44, the scraping member 41 is fitted into the receiving opening 44*e* that is formed in the top panel of the housing member 44. Thereafter, a seal member 51 is attached onto the scraping member 41 in the form of straddling the scraping member 41 and the housing member 44. Incidentally, the seal member 51 plays a role of preventing a toner leakage from the connection interface between the supply developer containing portion 33 and the supplying port shutter unit 35.

As described above, the supplying port shutter unit 35 has been completed. Incidentally, there is formed in the scraping member 41*a* through-hole 41*c* corresponding to the position of the developer supplying port 34. Furthermore, there is formed in the seal member 51 a similar through-hole 51*a* as well.

Figure 8:
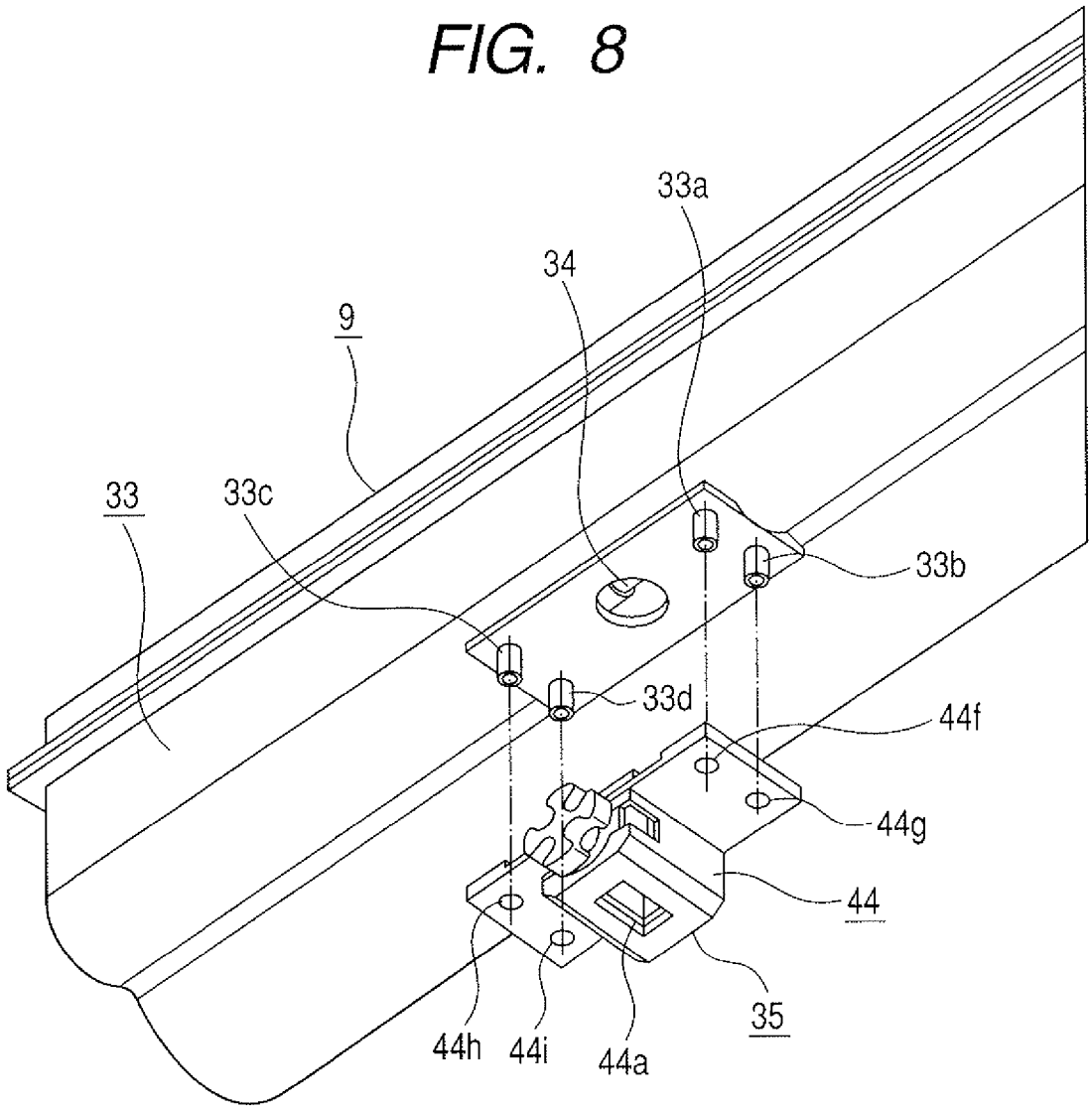
FIG. 8 is a perspective view illustrating mounting of the supplying port shutter unit to a developer supplying container.

The completed supplying port shutter unit 35 is connected to the developer supplying port 34 of the supply developer containing portion 33. To attach the supplying port shutter unit 35 to the supply developer containing portion 33, as illustrated in FIG. 8, positioning is made by fitting positioning holes 44*f*, 44*g*, 44*h* and 44*i* of the housing member 44 onto positioning shafts 33*a*, 33*b*, 33*c* and 33*d* on the supply developer containing portion 33. Furthermore, the positioning shafts 33*a*, 33*b*, 33*c* and 33*d* are heated and pressed (riveted) at their ends to be fixed.

Figure 9:
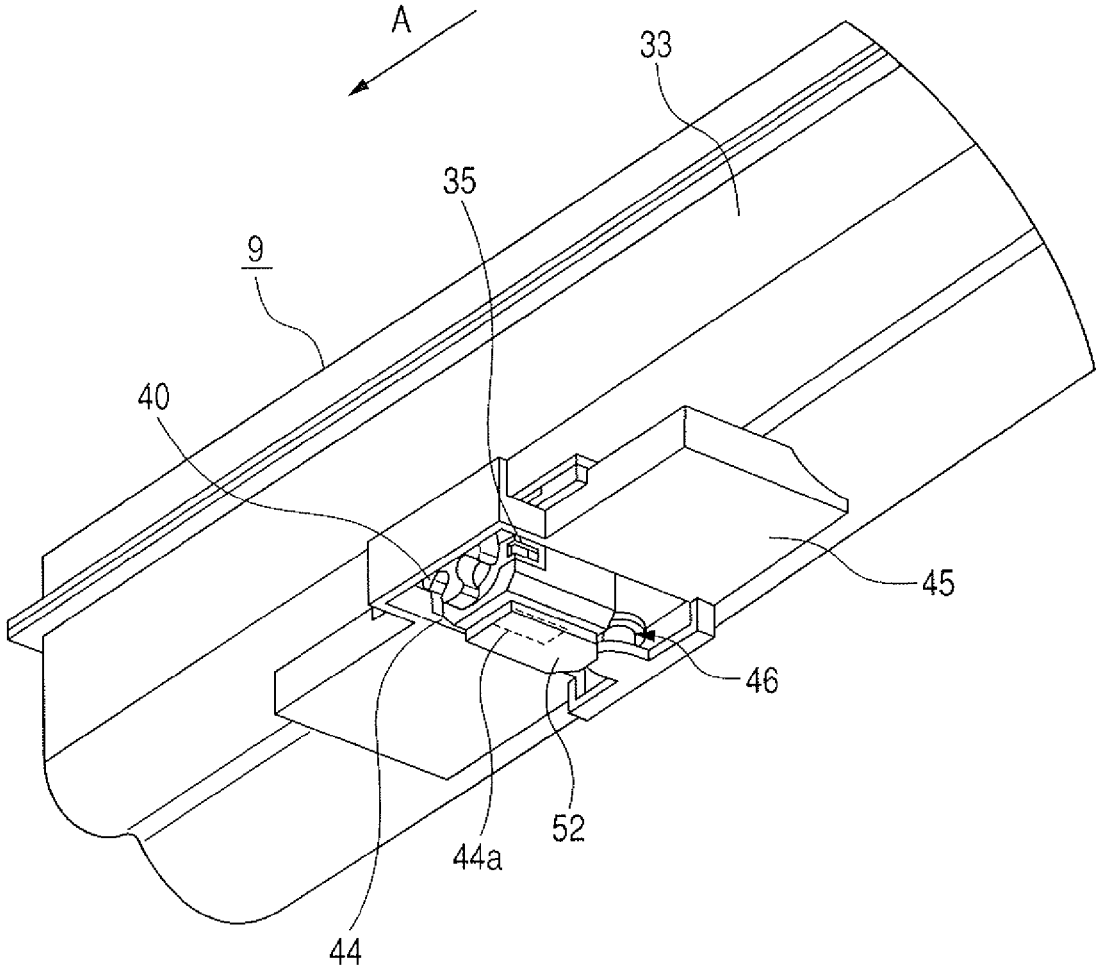
FIG. 9 is a perspective view of the developer supplying cartridge.
Figure 10:
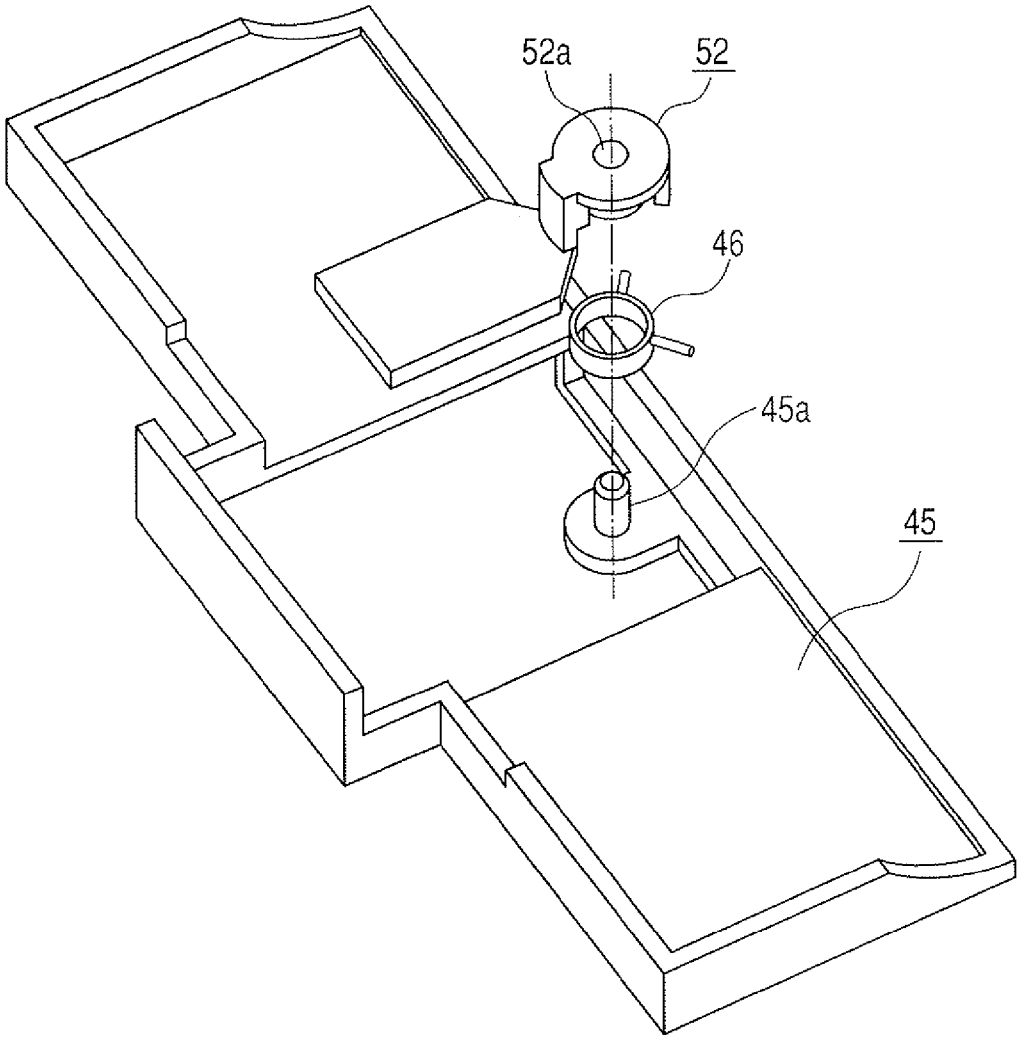
FIG. 10 is a perspective view illustrating mounting of an auxiliary cover to a cover member.

Moreover, to the underside of the housing member 44, as illustrated in FIG. 9, an auxiliary cover 52 covering the opening portion 44*a* is disposed. The auxiliary cover 52 is provided for preventing the developer adhering in the vicinity of the opening portion 44*a* in a developer supplying operation from the developer supplying cartridge 9 to the process cartridge 7 from dripping off to the outside when the developer supplying cartridge 9 is removed out of the apparatus main body 100*a*. Incidentally, the auxiliary cover 52, as illustrated in FIG. 10, is rotatably supported by a fit shaft 45*a* that is provided on a cover member 45 to cover the supplying port shutter unit 35 and a fit hole 52*a* of the auxiliary cover 52 being fitted. At this time, in the fit portion between the cover member 45 and the auxiliary cover 52, there is disposed a helical coil spring 46. Whereby, the auxiliary cover 52 is urged to the position of covering the opening portion 44*a*.

Figure 11A:
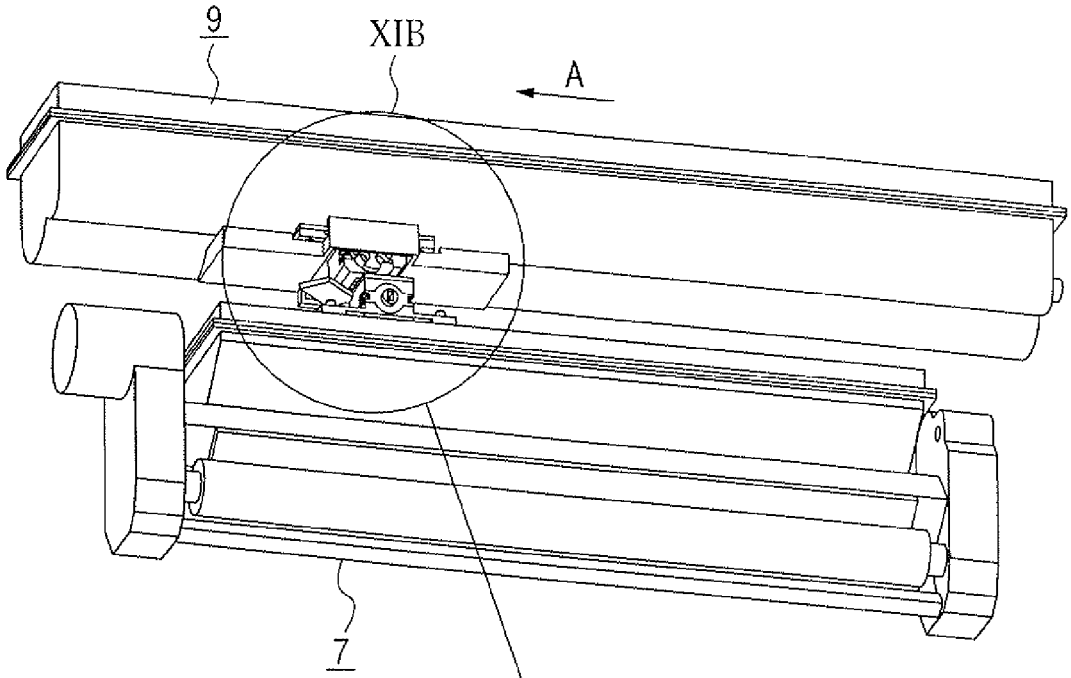
FIGS. 11A and 11B are explanatory views illustrating an opening/closing operation of the auxiliary cover.
Figure 11B:
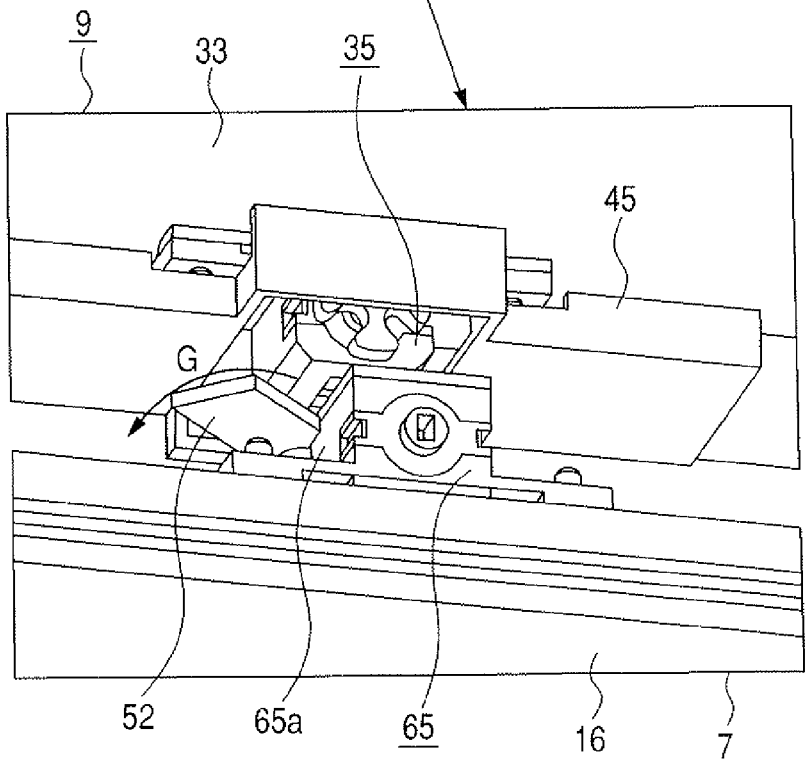

An opening/closing operation of the auxiliary cover 52 is as follows. As illustrated in FIGS. 11A and 11B, in the state in which the developer supplying cartridge 9 is mounted in the apparatus main body 100*a*, when the process cartridge 7 is inserted in the direction indicated by an arrow A in FIG. 11A, the auxiliary cover 52 is pushed by an engaging face 65*a* of the supplied port unit 65 that is provided at the process cartridge 7. Whereby, the auxiliary cover 52 is rotated in a direction indicated by an arrow G in FIG. 11B. Then, when the process cartridge 7 or the developer supplying cartridge 9 is removed out of the apparatus main body 100*a*, the auxiliary cover 52 comes not to be pushed by the engaging face 65*a* of the supplied port unit 65. Therefore, by the provision of an urging force from the helical coil spring 46, the auxiliary cover 52 is returned to the position of covering the opening portion 44*a*.

(Opening/Closing Operation of a Supplying Port Shutter Unit)

Figure 12:
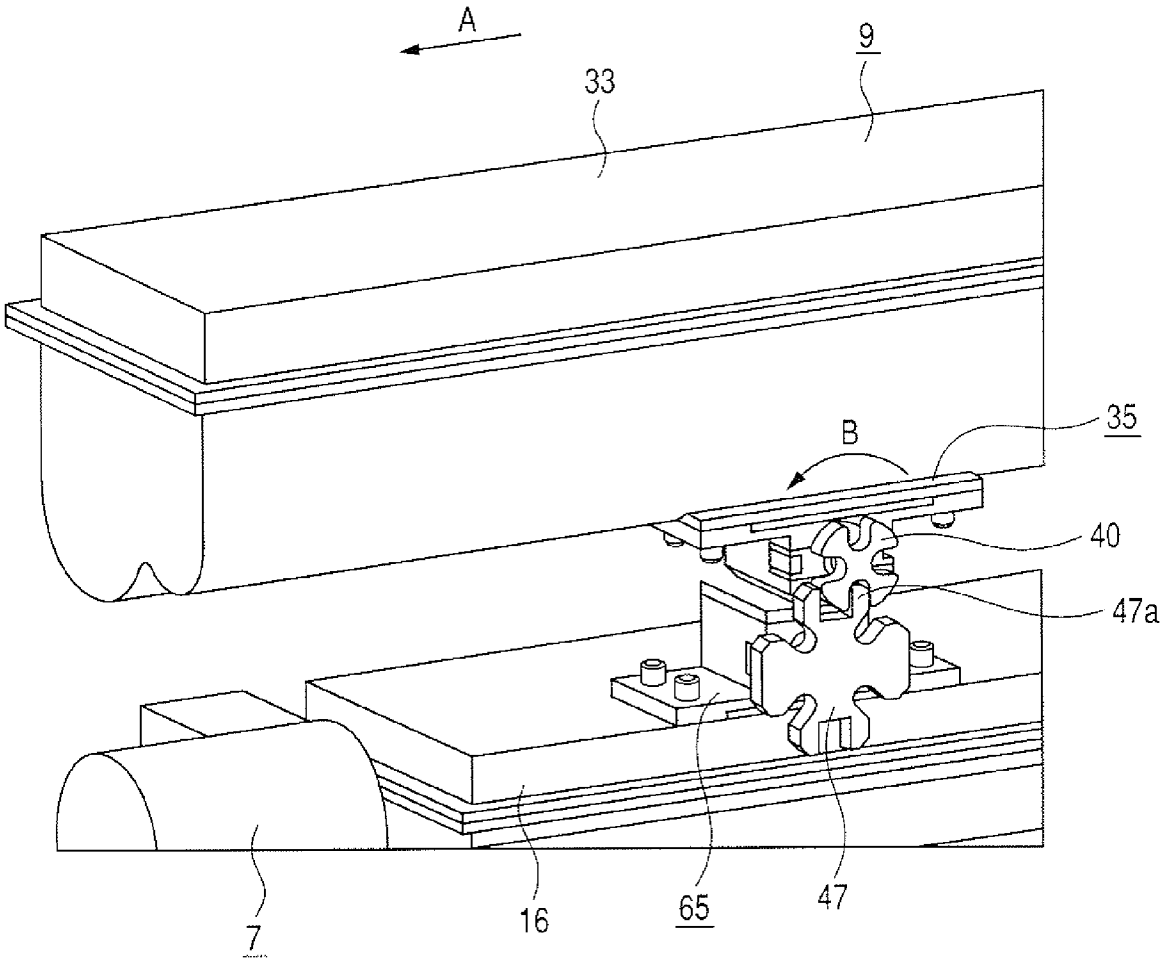
FIG. 12 is a perspective view illustrating the opening/closing operation of the supplying port shutter unit.

Now, the opening/closing operation of the supplying port shutter unit 35 will be described with reference to FIGS. 12 and 13.

First, the case where the developer supplying cartridge 9 is to be mounted in the image forming apparatus 100*a* after the process cartridge 7 is mounted will be described.

The supplying port shutter unit 35 of the developer supplying cartridge 9 before mounted in the apparatus main body 100*a* is in the closed state, that is, the cylindrical member 37 is in the position (developer supply stopping position) in which the cylindrical member 37 has been rotated 90 degrees from the state of FIG. 6. Subsequently, as illustrated in FIG. 12, the developer supplying cartridge 9 is mounted in the direction indicated by an arrow A with respect to the apparatus main body 100*a*. At this time, the acting portion 40 that is attached to the end of the shaft portion 37*c* of the cylindrical member 37 is engaged with an arm 47*a* of an acted portion 47 that is provided in the process cartridge 7, and the acting portion 40 is rotated 90 degrees in the direction indicated by an arrow B. Accompanied by this movement, the cylindrical member 37 is constructed to also rotate 90 degrees to be brought into the state illustrated in FIG. 6, resulting in an open developer supplying port 34.

Moreover, on the occasion when the developer supplying cartridge 9 is removed out of the apparatus main body 100*a*, the above-described operation is made in the reverse order, the developer supplying port 34 of the developer supplying cartridge 9 having been removed out comes to be in the closed state.

Figure 13:
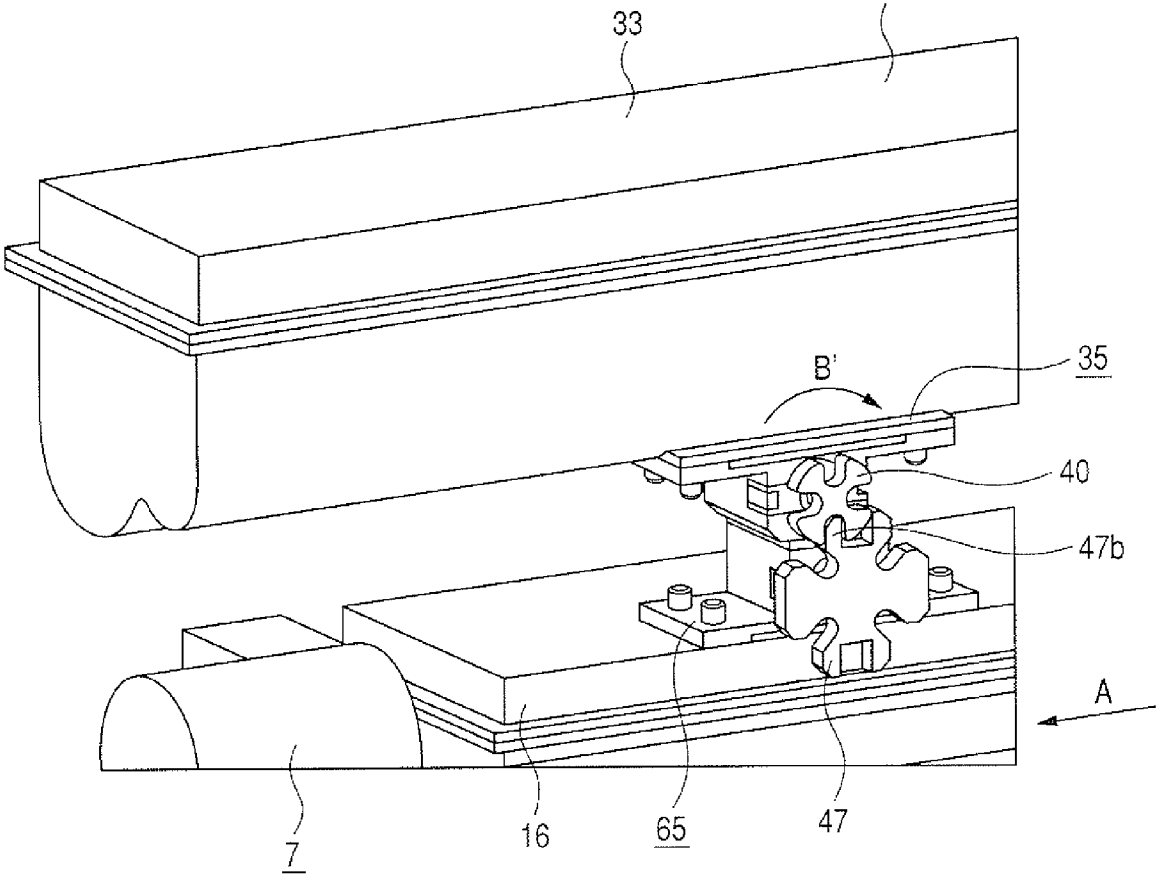
FIG. 13 is a perspective view illustrating the opening/closing operation of the supplying port shutter unit.

Now, in the case where the process cartridge 7 is to be mounted in the apparatus main body 100*a* after the developer supplying cartridge 9 has been mounted, as illustrated in FIG. 13, an arm 47*b* of the acted portion 47 is engaged with the acting portion 40, and the acting portion 40 is rotated 90 degrees in the direction indicated by an arrow B' by the arm 47*b*. In association with this movement, the cylindrical member 37 is also rotated 90 degrees to open the developer supplying port 34. Incidentally, as with the developer supplying cartridge 9, on the occasion of removing the process cartridge 7 out of the apparatus main body 100*a*, the reverse operation to that at the time of being inserted can be performed.

(Scraping Construction of a Cylindrical Member)

Now, a scraping construction of the cylindrical member 37 will be described with reference to FIG. 6.

As illustrated in FIG. 6, a first abutment portion 41*a* is provided on one side of the scraping member 41 and a second abutment portion 41*b* is provided on the other side of the scraping member 41 while sandwiching an opening portion vertically on the upper side of the through-hole 37*b* when the cylindrical member 37 is in an open state. Incidentally, tip ends of the first abutment portion 41*a* and second abutment portion 41*b* are extended in parallel with the rotation axis of the cylindrical member 37, as well as being constructed in the shape of an edge.

Due to that the first abutment portion 41*a* and second abutment portion 41*b* are abutted on the outer circumferential surface 37*a* of the cylindrical member 37, the developer in the supply developer containing portion 33 can be prevented from entering a gap between the outer circumferential surface 37*a* of the cylindrical member 37 and the housing member 44. Furthermore, the seal member 51 that is attached onto the scraping member 41 has an inroad amount of 0.6 mm to 1.2 mm with respect to the supply developer containing portion 33. Therefore, a repulsive force (in a direction indicated by an arrow F in FIG. 6) owing to the collapse of the seal member 51 is exerted on the scraping member 41. By this repulsive force, the scraping member 41 presses the cylindrical member 37. As a result, the outer circumferential surface 37*a* of the cylindrical member 37 is abutted on the bearing portion 44*b* of the housing member 44 with no gap. That is, even if the developer adhering to the through-hole 37*b* of the cylindrical member 37 enters a gap 48 between the outer circumferential surface 37*a* of the cylindrical member 37 and the housing member 44 at the time of rotation of the cylindrical member 37, the leakage of the developer from the opening portion 44*a* of the housing member 44 can be prevented.

Moreover, the first abutment portion 41*a* and the second abutment portion 41*b* are provided on the scraping member 41. Whereby, at the rotation of the cylindrical member 37, the developer adhering to the outer circumferential surface 37*a* of the cylindrical member 37 is scraped off by the first abutment portion 41*a* and the second abutment portion 41*b*. Scraping of the developer by the first abutment portion 41*a* and the second abutment portion 41*b* is conducted when the supplying port shutter unit 35 comes to be in the open state from the closed state.

Figure 14:
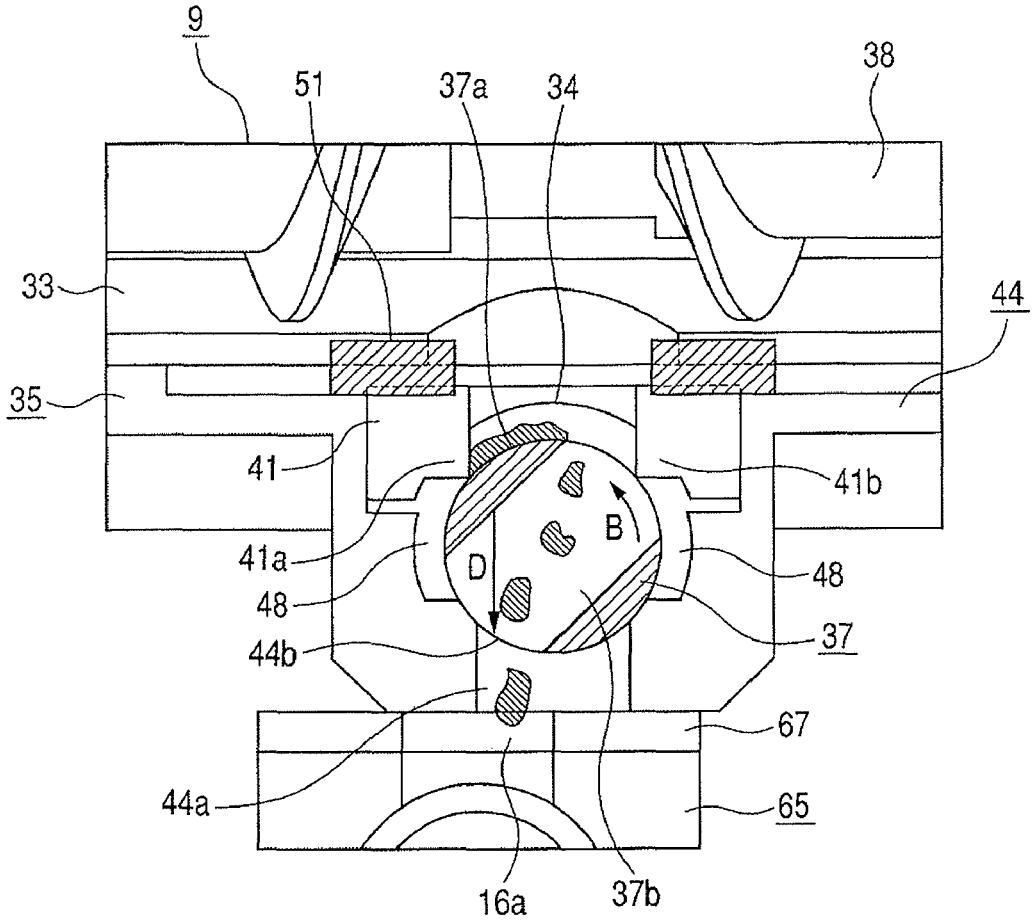
FIG. 14 is an explanatory view illustrating the state in which the developer having been scraped off by a scraping member drips off of a through-hole.

Furthermore, when the cylindrical member 37 is in the open state, the abutment portions 41*a* and 41*b* are located so as to position in the proximity of the opening portion 44*a* on the upper side of the through-hole 37*b* in the vertical direction. Therefore, as illustrated in FIG. 14, on the occasion when the cylindrical member 37 is rotated in a direction indicated by an arrow B, the developer having been scraped off by the first abutment member 41*a* drips in a direction indicated by an arrow D from the opening portion 44*a* of the housing member 44 to the developer supplied port 16*a* of the process cartridge 7 (refer to FIG. 14).

At this time, the first abutment portion 41*a* and the second abutment portion 41*b* of the scraping member 41 make inroads with respect to the outer circumferential surface 37*a* of the cylindrical member 37. In the case of a small inroad amount, a scraping performance of the developer comes to be insufficient. On the contrary, in the case of a large inroad amount, a rotation load of the cylindrical member 37 is augmented. Then, in this embodiment, to reduce the rotation load of the cylindrical member 37, it is desirable that the scraping member 41 be made of a material having elasticity such as elastomer, rubber or silicon.

In addition, when the diameter of the outer circumferential surface 37*a* of the cylindrical member 37 is 10 mm, the inroad amount of the first abutment portion 41*a* and the second abutment portion 41*b* with respect to the outer circumferential surface 37*a* of the cylindrical member 37 is desirably 0.1 mm to 0.6 mm. Furthermore, to reliably scrape off the developer adhering to the outer circumferential surface 37*a* of the cylindrical member 37, the tip ends of the first abutment portion 41*a* and the second abutment portion 41*b* are desirably formed in the shape of an edge of not more than R 0.5 (0.5 mm in radius).

Moreover, in the construction of the first embodiment, the position of the cylindrical member 37 is determined by putting the lower side of the outer circumferential surface 37*a* on the bearing portion 44*b* and further by pressing the upper side of the outer circumferential surface 37*a* by the first abutment portion 41*a* and the second abutment portion 41*b* of the scraping member 41. Furthermore, the seal member 51 is disposed on the upper portion of the scraping member 41. Therefore, by the provision of the repulsive force from the collapsed seal member 51, the scraping member 41, as illustrated in FIG. 6, can be moved in the direction indicated by the arrow F. With the arrangement, it is unnecessary for each part to be dimensioned excessively with precision. The increase of the rotation load of the cylindrical member 37 can be suppressed while a sufficient scraping performance of the outer circumferential surface 37*a* of the cylindrical member 37 is being obtained.

Moreover, due to that the scraping member 41 having elasticity is made to abut against the outer circumferential surface 37*a* of the cylindrical member 37, the outer circumferential surface 37*a* of the cylindrical member 37 is urged against the bearing portion 44*b* of the housing member 44. Therefore, without the need of increasing a dimensional precision of each part, the increase of the rotation load of the cylindrical member 37 can be suppressed.

In addition, because of a simple construction of the scraping member 41 just being mounted on the cylindrical member 37, assembling is easy and downsizing can be achieved.

Owing to the above-described construction, in a supplying port shutter construction of the developer supplying cartridge employing a rotary valve system, while reducing the leakage of the developer from around the supplying port, the increase of the rotation load of the cylindrical member can be suppressed. In addition, in a simple construction, a supplying port shutter construction of the rotary valve system with which downsizing is achieved can be provided.

Embodiment 2

Now, a scraping construction of the cylindrical member 37 according to a second exemplary embodiment will be described with reference to FIG. 15. Incidentally, since a basic construction of an apparatus according to this embodiment is the same as that of the above-described embodiment, the repetition of descriptions will be omitted. Here, constructions to be characteristic of this embodiment will be described. In addition, members having the same functions as those of the above-described embodiment will be designated with like reference numerals.

Figure 15:
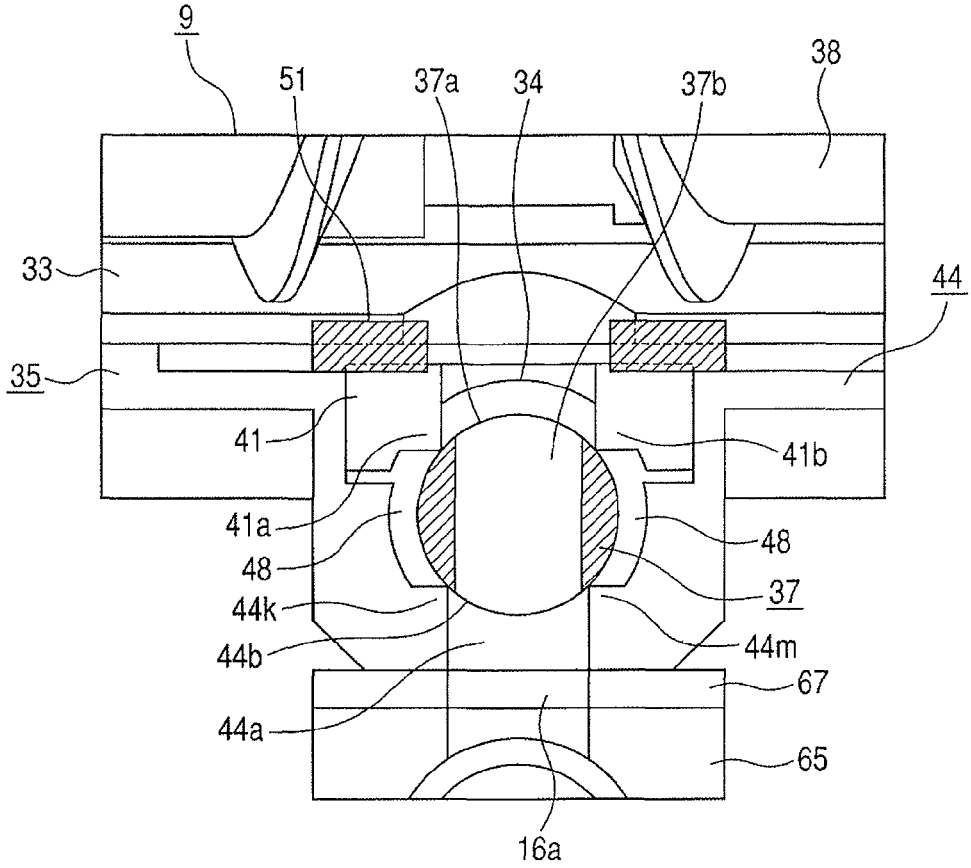
FIG. 15 is a sectional view of a supplying port shutter unit according to a second exemplary embodiment.

As illustrated in FIG. 15, a third abutment portion 44*k* as a bearing portion is provided on one side of the housing member 44 and a fourth abutment portion 44*m* as a bearing portion is provided on the other side of the housing member 44 while sandwiching the opening portion 44*a* of the vertically lower side of the through-hole 37*b* when the cylindrical member 37 is in the open state. These abutment portions 44*k* and 44*m* are formed in the shape of an edge.

The cylindrical member 37 is disposed in the housing member 44, and due to that the third abutment portion 44*k* and the fourth abutment portion 44*m* receive the outer circumferential surface 37*a* of the cylindrical member 37, the cylindrical member 37 is rotatably supported with respect to the housing member 44.

Owing to the above-mentioned construction, even if at the rotation of the cylindrical member 37, the developer adhering to the through-hole 37*b* of the cylindrical member 37 enters the gap 48 between the outer circumferential surface 37*a* of the cylindrical member 37 and the housing member 44, the developer can be prevented from being leaked from the opening portion 44*a* of the housing member 44.

Furthermore, compared with the amount of the developer entering from the supply developer containing portion 33, the amount of the developer adhering to the through-hole 37*b* of the cylindrical member 37 entering the gap between the outer circumferential surface 37*a* of the cylindrical member 37 and the housing member 44 is a very small quantity. Thus, there are provided as a buffer portion the gaps 48 in which the developer can be retained between the housing member 44 and the cylindrical member 37 vertically below the first abutment portion 41*a* and the second abutment portion 41*b* and vertically above the third abutment portion 44*k* and the fourth abutment portion 44*m*.

With the arrangement, even if the developer adhering to the through-hole 37*b* of the cylindrical member 37 enters the gap 48 between the outer circumferential surface 37*a* of the cylindrical member 37 and the housing member 44, it is possible not to increase the rotation load of the cylindrical member 37.

Incidentally, at the rotation of the cylindrical member 37, the developer adhering to the outer circumferential surface 37*a* of the cylindrical member 37 is scarped off by the first abutment portion 41*a* and the second abutment portion 41*b*. Furthermore, since the third abutment portion 44*k* and the fourth abutment portion 44*m* of the housing member 44 functions similarly to the first abutment portion 41*a* and the second abutment portion 41*b*, the developer adhering to the outer circumferential surface 37*a* of the cylindrical member 37 can be scarped off more reliably.

Moreover, scraping of the developer by the first to the fourth abutment portions 41*a*, 41*b*, 44*k* and 44*m* are conducted when the supplying port shutter unit 35 comes to be in the open state from in the closed state. Therefore, the developer having been scraped off drips off from the opening portion 44*a* of the housing member 44 to the developer supplied port 16*a* of the process cartridge 7.

Incidentally, in this embodiment, to reliably scrape off the developer adhering to the outer circumferential surface 37*a* of the cylindrical member 37, the first abutment portion 41*a*, the second abutment portion 41*b*, the third abutment portion 44*k* and the fourth abutment portion 44*m* are desired to be edge-shaped at their tip ends. More specifically, when the diameter of the outer circumferential surface 37*a* of the cylindrical member 37 is 10 mm, the tip ends of the first abutment portion 41*a*, the second abutment portion 41*b*, the third abutment portion 44*k* and the fourth abutment portion 44*m* are desired to be not more than R 0.5 (0.5 mm in radius).

Embodiment 3

Now, a third exemplary embodiment of the present invention will be described with reference to FIG. 16. Incidentally, since an image forming apparatus and a supplying port shutter unit construction of a developer supplying cartridge according to the third embodiment are the same as those of the above-described embodiments, the repetition of descriptions will be omitted. Here, constructions to be characteristic of the third embodiment will be described. Furthermore, members having the same functions as is the above-described embodiments are designated with like reference numerals.

In the above-described first embodiment, shown is the example in which the supplying port shutter unit 35 is provided at the developer supplying port 34 of the developer supplying cartridge 9. In the third embodiment, shown is an example in which a supplied port shutter unit 70 as a developer supplied port shutter portion is also provided at the supplied port 16*a* of the process cartridge 7, and this supplied port shutter unit 70 is constructed so as to open and close in association with the supplying port shutter unit 35.

Figure 16:
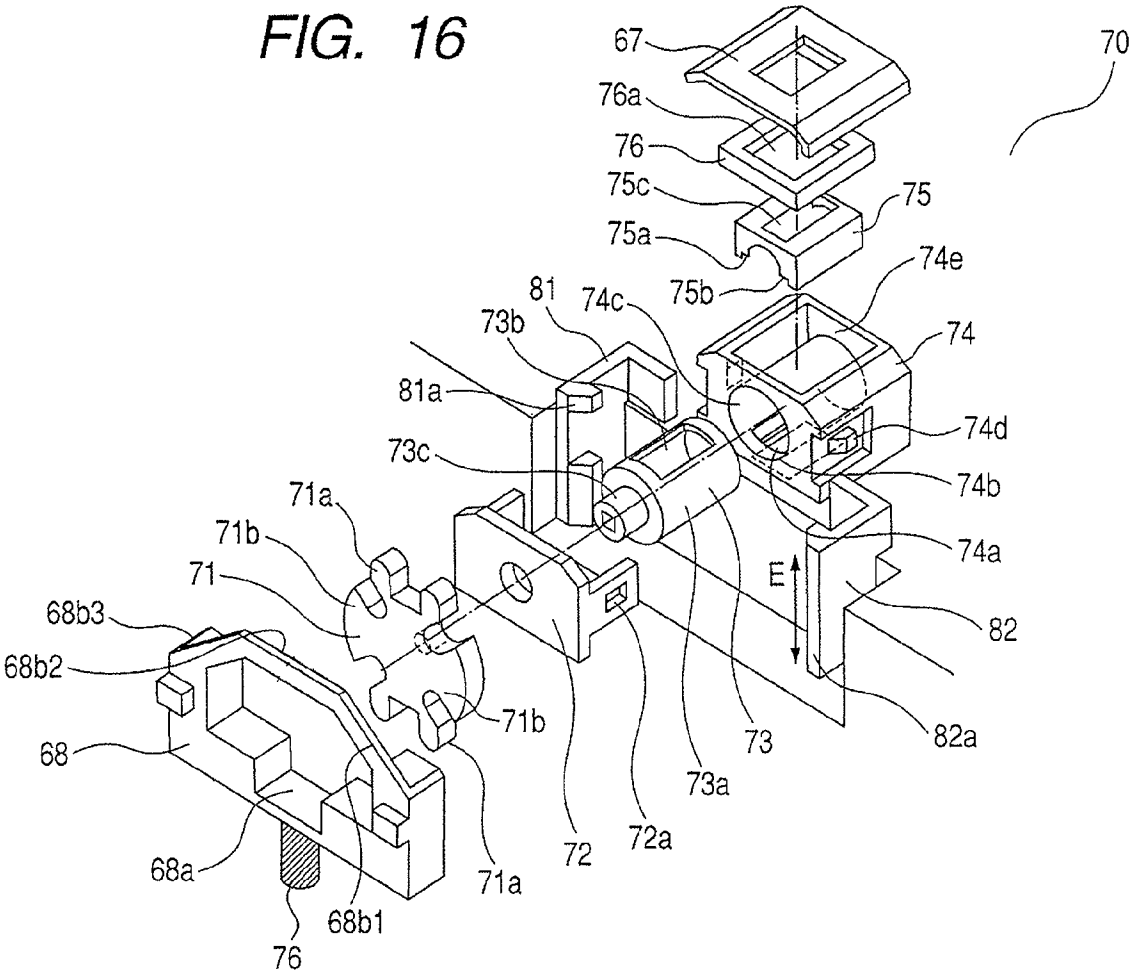
FIG. 16 is a perspective view illustrating mounting of a cylindrical member with respect to a housing member of a process cartridge according to a third exemplary embodiment.

FIG. 16 is an exploded perspective view of the supplied port shutter unit 70 that is provided instead of the supplied port unit 65 of the process cartridge 7 shown in the first embodiment. As illustrated in FIG. 16, a shutter mechanism of the process cartridge 7 according to this embodiment employs the same construction as the shutter mechanism of the developer supplying cartridge 9.

Here, an acting portion 71 of the supplied port shutter unit 70 illustrated in FIG. 16 corresponds to the acting portion 40 of the supplying port shutter unit 35 illustrated in FIG. 7. Likewise, a supplied port housing cover 72 corresponds to the housing cover 39, and an attaching hole 72*a* corresponds to the attaching hole 39*a*. Moreover, a cylindrical member 73, an outer circumferential surface 73*a*, a through-hole 73*b*, and a shaft portion 73*c* illustrated in FIG. 16 correspond to the cylindrical member 37, the outer circumferential surface 37*a*, the through-hole 37*b* and the shaft portion 37*c* illustrated in FIG. 7, respectively. In addition, a housing member 74, an opening portion 74*a*, a bearing portion 74*b*, a cylindrical member attaching portion 74*c*, a claw portion 74*d* and an opening portion 74*e* illustrated in FIG. 16 correspond to the opening portion 44*a*, the bearing portion 44*b*, the cylindrical member attaching portion 44*c*, the claw portion 44*d*, and the opening portion 44*e* illustrated in FIG. 7, respectively. Furthermore, a scraping member 75, a first abutment portion 75*a*, a second abutment portion 75*b* and a through-hole 75*c* illustrated in FIG. 16 correspond to the scraping member 41, the first abutment portion 41*a*, the second abutment portion 41*b* and the through-hole 41*c* illustrated in FIG. 7, respectively. In addition, a seal member 76 and a through-hole 76*a* illustrated in FIG. 16 correspond to the seal member 51 and the through-hole 51*a* illustrated in FIG. 7, respectively.

The construction of the above-mentioned corresponding portions are the same as like portions of the developer supplying cartridge 9, so that detailed descriptions will be omitted.

Furthermore, a regulating member 68 for regulating the rotation of the acting portion 71 is provided at the supplied port shutter unit 70 of the process cartridge 7. The regulating member 68 is provided so as to be capable of sliding in the vertical direction (in a direction indicated by an arrow E) by claw portions 81*a* and 82*a* of slide rails 81 and 82 that are provided at the receiving side developer containing portion 16. Moreover, the regulating member 68 is urged upward all the time by a spring force (elastic force) from a compression spring 76 that is provided between the receiving side developer containing portion 16 and the regulating member 68. Then, when the regulating member 68 is in a home position, a regulating concave portion 68*a* that is provided in the regulating member 68 and protrusions 71*a* and 71*b* of the acting portion 71 are constructed to sequentially engage with each other. With the arrangement, the rotation of the acting portion 71 is regulated. That is, due to that the protrusions 71*a* and 71*b* are fitted to the concave portion 68*a*, the rotation of the acting portion 71 is regulated.

Now, a shutter opening/closing operation when the above-described developer supplying cartridge 9 is mounted onto an apparatus main body 100*a* to which the process cartridge 7 provided with the above-mentioned supplied port shutter unit 70 has been mounted will be described with reference to FIGS. 17A to 17K. Incidentally, before the developer supplying cartridge 9 is mounted, both the supplied port shutter unit 70 and the supplying port shutter unit 35 are in the closed state.

Figure 17K:
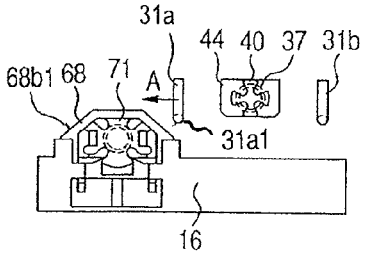
FIGS. 17A, 17B, 17C, 17D, 17E, 17F, 17G, 17H, 17I, 17J and 17K are explanatory views of the opening/closing operation of a shutter of a developer supplying cartridge and a process cartridge according to the third embodiment.
Figure 17J:
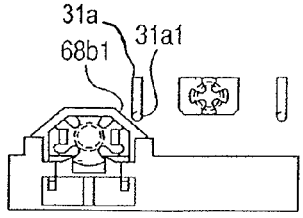

An operator inserts the developer supplying cartridge 9 into the apparatus main body 100*a* (in a direction indicated by an arrow A in FIG. 17K).

At the developer supplying cartridge 9 according to this embodiment, as illustrated in FIG. 17K, in the longitudinal direction of the developer supplying cartridge 9, there are provided a first engaging member 31*b* on one side of the supplying port shutter unit 35 and a second engaging member 31*a* on the other side. Then, when the developer supplying cartridge 9 is entered to the position of FIG. 17J, an engaging portion 31*a*1 of the second engaging member 31*a* that is provided at the developer supplying cartridge 9 is contacted with a guide surface of slope portion 68*b*1 of a guide surface 68*b* of the regulating member 68.

Figure 17I:
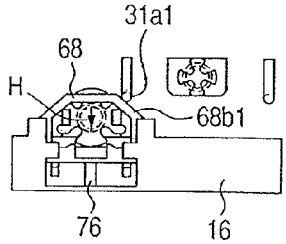

Then, accompanied by a further entry of the developer supplying cartridge 9, as illustrated in FIG. 17I, the slope portion 68*b*1 is guided by the engaging portion 31*a*1. Therefore, the regulating member 68 having been urged in an upper regulating position by the elastic force from the compression spring 76, against the elastic force, moves downward (in a direction indicated by an arrow H of FIG. 17I) to a movement allowing position (rotation allowing position) where the receiving side developer containing portion 16 is provided.

Figure 17H:
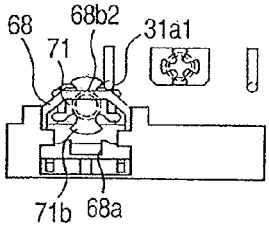
Figure 17G:
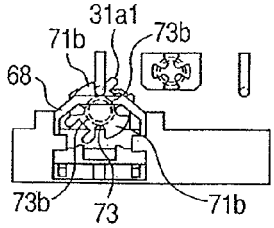

When the engaging portion 31*a*1 of the developer supplying cartridge 9 reaches a plane portion 68*b*2 of the regulating member 68*b*, the engagement between the regulating concave portion 68*a* of the regulating member 68 and the protrusion 71*b* of the acting portion 71 is released. Whereby, the acting portion 71 is in the state of being allowed to rotate (FIG. 17H).

Thereafter, the engaging portion 31*a*1 moves while sliding on the plane portion 68*b*2 of the regulating member 68. Then, the engaging portion 31*a*1 is engaged with the protrusion 71*b* of the acting portion 71 to cause the acting portion 71 to rotate in a counterclockwise direction (illustrated in FIG. 17G). Accompanied by the rotation of the acting portion 71, the cylindrical member 73 fixed to the acting portion 71 is rotated in the counterclockwise direction along with the acting portion 71. Whereby, the cylindrical member 73 is in the developer receiving allowing position, to be in the state in which the through-hole 73*b* is open.

Figure 17F:
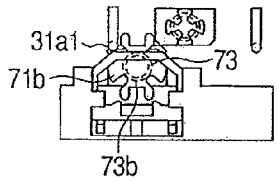

When the developer supplying cartridge 9 has moved to the position where the engagement between the engaging portion 31*a*1 and the acting portion 71 is released, the cylindrical member 73 is rotated 90 degrees. Whereby, the rotation of the acting portion 71 is stopped. Then, the cylindrical member 73 comes to be in the open state in which the developer can be received from the developer supplying cartridge 9 (FIG. 17F).

Figure 17E:
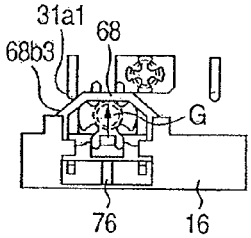
Figure 17D:
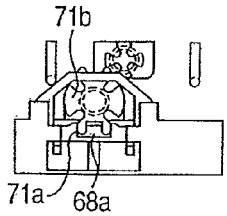

As illustrated in FIGS. 17E to 17D, when the developer supplying cartridge 9 has been entered further in an internal part of the apparatus main body 100*a*, a slope portion 68*b*3 is guided by the engaging portion 31*a*1. Therefore, the regulating member 68 is moved to the regulating position upward (in a direction indicated by an arrow G of FIG. 17E) with respect to the receiving side developer containing portion 16 by the elastic force (compression spring force) from the spring 76.

Figure 17C:
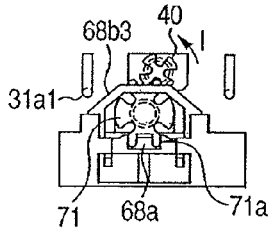

Then, the engaging portion 31*a*1 of the developer supplying cartridge 9 is separated from the slope portion 68*b*3 of the guide surface 68*b*2. Thus, the protrusion 71*a* is engaged with the regulating concave portion 68*a* of the regulating member 68. Then, the acting portion 71 is returned to the state in which the rotation thereof is regulated (FIG. 17C).

Figure 17B:
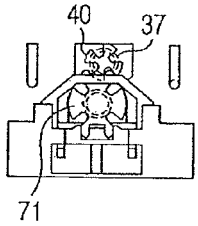
Figure 17A:
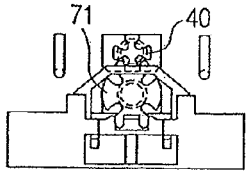

From this state, the developer supplying cartridge 9 is entered further into an internal part of the apparatus main body 100*a*. Whereby, the protrusion and the concave portion of the acting portion 40 of the developer supplying cartridge 9 and the protrusion 71*a* of the acting portion 71 of the process cartridge 7 are engaged. At this time, the rotation of the acting portion 71 is regulated by the regulating member 68. Thus, the acting portion 40 on the developer supplying cartridge side, accompanied by the entry movement of the developer supplying cartridge 9, is rotated in the counterclockwise direction (in a direction indicated by an arrow I of FIG. 17C) under the force from the acting portion 71. Accompanied by the rotation of the acting portion 40, the cylindrical member 37 that is fixed thereto is rotated in the counterclockwise direction as well. Then, the supplying port shutter unit 35 is opened (FIGS. 17C to 17B). That is, the supplying port shutter unit 35 of the developer supplying cartridge 9 comes to be in the developer supply allowing position (FIG. 17A).

Furthermore, on the occasion when the developer supplying cartridge 9 is removed out of the apparatus main body 100*a*, the above-described operation is made in the reverse sequence. Thus, the cylindrical member 73 of the process cartridge 7 is rotated to the developer receiving stopping position to be in the state in which the through-hole 73*b* is closed. In addition, at the same time as this event, the supplying port of the developer supplying cartridge 9 comes to be in the closed state as well.

As described above, a shutter unit is provided on the developer supplying port 34 of the process cartridge 7 so that the developer supplying port 34 is constructed so as to be capable of being opened and closed in association with mounting/dismounting of the developer supplying cartridge 9. Such a supplied port shutter unit 70 of the process cartridge 7 may be constructed such that a scraping member 75 is abutted on the outer circumferential surface 73*a* of the cylindrical member 73, and the developer adhering to this outer circumferential surface 73*a* of the cylindrical member 73 is scraped off.

Owing to the above-described construction, in the supplied port shutter construction of a process cartridge employing the rotary valve system, while the developer leakage from around the supplying port being reduced, the increase of a rotation load of the cylindrical member can be suppressed. Furthermore, a supplying port shutter construction of the rotary valve system with which downsizing is achieved in a simple construction can be provided.

According to the embodiments of the present invention, since a scraping member is abutted on the outer circumferential surface of the cylindrical member, on the occasion when the cylindrical member is rotated, the developer adhering to the outer circumferential surface of the cylindrical member can be scraped off by the scraping member. With the arrangement, the developer leakage around the supplying opening at the time of mounting and dismounting the developer supplying cartridge can be reduced.

Moreover, according to the embodiments of the present invention, the entry of the developer between the housing member and the outer circumferential surface of the cylindrical member can be regulated. With the arrangement, the increase of the rotation load of the cylindrical member with the developer having entered therebetween can be prevented. Therefore, the cylindrical member is smoothly rotated in the housing member, thus enabling to smoothly open and close the supplying opening.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-202449, filed Aug. 3, 2007, which is hereby incorporated by reference herein in its entirety.

What is claimed is:

1. A developer supplying cartridge detachably mountable to an electrophotographic image forming apparatus main body, the developer supplying cartridge supplying a developer to a developing device for developing an electrostatic latent image having been formed on an electrophotographic photosensitive drum, the developer supplying cartridge comprising:

a supply developer containing portion containing the developer;

a developer supplying port for supplying the developer in the supply developer containing portion to the developing device via a supplied port of the developing device; and a supplying port shutter portion that opens and closes the developer supplying port, wherein the supplying port shutter portion includes:

a housing member covering the developer supplying port;

a cylindrical member which is rotatably disposed in the housing member and in which a through-hole corresponding to the developer supplying port is formed and which assumes, by rotation of the cylindrical member, a developer supply allowing position where the developer supplying port and the through-hole communicate with each other and a developer supply stopping position where the developer supplying port is closed; and a scraping member which is abutted on an outer circumferential surface of the cylindrical member to scrape off the developer adhering to the outer circumferential surface of the cylindrical member, which is rotated.

2. A developer supplying cartridge according to claim 1, wherein the housing member is provided with a bearing portion supporting the rotation of the cylindrical member, and wherein the scraping member has elasticity, and the cylindrical member is urged to the bearing portion by an abutment of the scraping member against the cylindrical member.

3. A developer supplying cartridge according to claim 1, wherein an abutment portion of the scraping member to be abutted against the cylindrical member is provided with a first abutment portion on one side and a second abutment portion on another side while sandwiching an opening portion on a vertically upper side of the through-hole when the cylindrical member is in the developer supply allowing position.

4. A developer supplying cartridge according to claim 3, wherein in order for a developer having been scraped off by the first abutment portion or the second abutment portion to drip off from an opening portion of the through-hole when the cylindrical member is rotated from the developer supply stopping position to the developer supply allowing position, at a time when the cylindrical member is in the developer supply allowing position, the abutment portion is positioned in proximity of the opening portion on the vertically upper side of the through-hole.

5. A developer supplying cartridge according to claim 3, wherein the housing member is provided with a bearing portion supporting the rotation of the cylindrical member, and wherein the bearing portion is provided with a third abutment portion on one side and a fourth abutment portion on another side while sandwiching an opening portion on a vertically lower side of the through-hole when the cylindrical member is in the developer supply allowing position.

6. A developer supplying cartridge according to claim 5, comprising a buffer portion disposed between the housing member and the cylindrical member vertically below the first abutment portion and the second abutment portion as well as vertically above the third abutment portion and the fourth abutment portion.

7. A developer supplying cartridge according to claim 3, wherein tip ends of the first abutment portion and the second abutment portion are extended in parallel with a rotation axis of the cylindrical member and each formed in a shape of an edge.

8. An electrophotographic image forming apparatus in which a developer supplying cartridge supplying a developer to a developing device is detachably mountable to an apparatus main body, the electrophotographic image forming apparatus comprising:

a developer supplying cartridge mounting portion; and a developer supplying cartridge according to claim 1 that is mounted to the developer supplying cartridge mounting portion.

9. A developer supplying cartridge detachably mountable to an apparatus main body of an electrophotographic image forming apparatus that supplies a developer to a process cartridge including: an electrophotographic photosensitive drum; a developing roller for developing an electrostatic latent image formed on the electrophotographic photosensitive drum; and a supplied port shutter portion that assumes a developer receiving allowing position in which a supplied port for receiving a developer for use in development by the developing roller is opened and a developer receiving stopping position in which the supplied port is closed, the developer supplying cartridge comprising:

a supply developer containing portion containing the developer;

a developer supplying port for supplying the developer in the supply developer containing portion to the process cartridge via the supplied port; and a supplying port shutter portion that opens and closes the developer supplying port, wherein the supplying port shutter portion includes:

a housing member covering the developer supplying port;

a cylindrical member which is rotatably disposed in the housing member and in which a through-hole corresponding to the developer supplying port is formed and which assumes, by rotation of the cylindrical member, a developer supply allowing position where the developer supplying port and the through-hole communicate with each other and a developer supply stopping position where the developer supplying port is closed; and a scraping member which is abutted on an outer circumferential surface of the cylindrical member to scrape off the developer adhering to the outer circumferential surface of the rotating cylindrical member.

* * * * *